US006398000B1

(12) United States Patent
Jenrick et al.

(10) Patent No.: US 6,398,000 B1
(45) Date of Patent: Jun. 4, 2002

(54) CURRENCY HANDLING SYSTEM HAVING MULTIPLE OUTPUT RECEPTACLES

(75) Inventors: Charles P. Jenrick, Chicago, IL (US); Matthew L. Anderson, Salem, WI (US); Robert J. Klein, Chicago, IL (US); Curtis W. Hallowell, Palatine, IL (US); Mark C. Munro, Park Ridge, IL (US); Cherrie L. Brown, Lombard, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 09/502,666

(22) Filed: Feb. 11, 2000

(51) Int. Cl.[7] ..... G07C 3/00; G07F 7/04; B07C 5/00; B65H 31/20; B65H 1/30

(52) U.S. Cl. ..... 194/200; 194/206; 209/534; 221/242; 271/158; 271/181

(58) Field of Search ..... 194/200, 206, 194/207; 209/534; 221/242; 271/180, 181, 157, 158, 149, 31.1; 414/790.3, 790.5, 790.8

(56) References Cited

U.S. PATENT DOCUMENTS

| | | | | |
|---|---|---|---|---|
| 3,245,534 | A | 4/1966 | Smith et al. | 382/7 |
| 3,246,295 | A | 4/1966 | DeClaris et al. | 382/56 |
| 3,280,974 | A | 10/1966 | Riddle et al. | 209/111.8 |

(List continued on next page.)

FOREIGN PATENT DOCUMENTS

| | | | |
|---|---|---|---|
| DE | 2659929 | B2 | 5/1976 |
| DE | 2935668 | A1 | 9/1979 |
| DE | 2935668 | C2 | 9/1979 |
| EP | 0077464 | A2 | 4/1983 |
| EP | 0101115 | A1 | 2/1984 |
| EP | 0130824 | A2 | 1/1985 |
| EP | 0130825 | A2 | 1/1985 |
| EP | 0132329 | A2 | 1/1985 |

(List continued on next page.)

OTHER PUBLICATIONS

Glory UW–200 Multipurpose Compact Currency Sorter, 4 pages, ©1999.
Glory UW–100 Compact Currency Fitness Sorter, 2 pages, ©1999.
Glory GFRT–1 Currency Scanner, 12/94.
Glory GFR–100 Currency Reader Counter Instruction Manual, 32 pages, Aug. 20, 1998.

(List continued on next page.)

*Primary Examiner*—Robert P. Olszewski
*Assistant Examiner*—Bryan Jaketic
(74) *Attorney, Agent, or Firm*—Jenkens & Gilchrist

(57) ABSTRACT

An apparatus for transferring a plurality of documents from a first compartment to a second compartment. The apparatus comprises a plunger assembly having a paddle adapted to contact the documents, and at least one outwardly extending arm hingedly connected to the plunger assembly. A gate is disposed between the first compartment and the second compartment forming a document supporting surface. The gate has an open position and a closed position. At least one lever extends from the gate, the lever being in a first position when the gate is in the closed position and the lever being in a second position when the gate is in the open position. The gate moves from the closed position to the open position when the paddle urges the documents against the gate from the first compartment towards the second compartment. The arm moves the lever from the second position to the first position to move the gate from the open position to the closed position when the paddle retracts from the second compartment to the first compartment.

89 Claims, 23 Drawing Sheets

U.S. PATENT DOCUMENTS

| | | | | |
|---|---|---|---|---|
| 3,443,107 | A | 5/1969 | Modglin | 250/219 |
| 3,480,785 | A | 11/1969 | Aufderheide | 250/219 |
| 3,496,370 | A | 2/1970 | Haville et al. | 250/219 |
| 3,509,535 | A | 4/1970 | Berube | |
| 3,612,835 | A | 10/1971 | Andrews et al. | 235/61.11 D |
| 3,618,765 | A | 11/1971 | Cooper et al. | 209/534 |
| 3,679,314 | A | 7/1972 | Mustert | 356/71 |
| 3,764,899 | A | 10/1973 | Peterson et al. | 324/61 R |
| 3,778,628 | A | 12/1973 | Novak et al. | 250/556 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | 209/111.8 |
| 3,906,449 | A | 9/1975 | Marchak | 340/146.3 R |
| 3,976,198 | A | 8/1976 | Carnes, Jr. et al. | 209/111.7 T |
| 4,041,456 | A | 8/1977 | Ott et al. | 340/146.3 R |
| 4,081,131 | A | 3/1978 | Sand et al. | 235/419 |
| 4,096,991 | A | 6/1978 | Iquchi | 235/419 |
| 4,114,804 | A | 9/1978 | Jones et al. | 235/476 |
| 4,147,430 | A | 4/1979 | Gorgone et al. | 356/51 |
| 4,164,770 | A | 8/1979 | Jeffers | |
| 4,167,458 | A | 9/1979 | Louzos et al. | |
| 4,179,685 | A | 12/1979 | O'Maley | 340/146.3 |
| 4,250,806 | A | 2/1981 | Boyson et al. | 101/2 |
| 4,255,651 | A | 3/1981 | Phillips | |
| 4,275,874 | A | 6/1981 | DiBlasio | |
| 4,277,774 | A | 7/1981 | Fuji et al. | 340/146.3 |
| 4,283,708 | A | 8/1981 | Lee | 340/146.32 |
| 4,288,781 | A | 9/1981 | Sellner et al. | 340/146.3 |
| 4,302,781 | A | 11/1981 | Ikeda et al. | |
| 4,311,914 | A | 1/1982 | Huber | |
| 4,313,598 | A | 2/1982 | Diblasio | |
| 4,332,348 | A | 6/1982 | Nordin | |
| 4,334,619 | A | 6/1982 | Horino et al. | 209/551 |
| 4,348,656 | A | 9/1982 | Gorgone et al. | |
| 4,349,111 | A | 9/1982 | Shah et al. | 209/534 |
| 4,352,988 | A | 10/1982 | Ishida | 250/559 |
| 4,355,300 | A | 10/1982 | Weber | 340/146.3 C |
| 4,356,473 | A | 10/1982 | Freudenthal | 340/146.3 H |
| 4,357,528 | A | 11/1982 | Smith et al. | 235/92 |
| 4,365,700 | A | 12/1982 | Arimato et al. | 194/2 |
| 4,376,364 | A | 3/1983 | Horino et al. | 53/54 |
| 4,381,447 | A | 4/1983 | Horvath et al. | |
| 4,386,432 | A | 5/1983 | Nakamura et al. | 382/7 |
| 4,388,662 | A | 6/1983 | Jeffers et al. | 360/113 |
| 4,398,088 | A | 8/1983 | Hirose et al. | 235/379 |
| 4,413,296 | A | 11/1983 | Jeffers | 360/113 |
| 4,442,541 | A | 4/1984 | Finkel et al. | 382/7 |
| 4,458,816 | A | 7/1984 | Horino et al. | |
| 4,461,028 | A | 7/1984 | Okubo | |
| 4,464,786 | A | 8/1984 | Nishito et al. | 382/7 |
| 4,464,787 | A | 8/1984 | Fish et al. | |
| 4,470,496 | A | 9/1984 | Steiner | 914/4 C |
| 4,470,590 | A | 9/1984 | Ariga et al. | 271/187 |
| RE31,692 | E | 10/1984 | Tyburski et al. | 382/7 |
| 4,479,049 | A | 10/1984 | Hirose | 235/279 |
| 4,480,177 | A | 10/1984 | Allen | 235/379 |
| 4,482,058 | A | 11/1984 | Steiner | 209/534 |
| 4,487,306 | A | 12/1984 | Nao et al. | 382/135 |
| 4,490,846 | A | 12/1984 | Ishida et al. | |
| 4,501,418 | A | 2/1985 | Ariga et al. | |
| 4,503,963 | A | 3/1985 | Steiner | |
| 4,513,439 | A | 4/1985 | Gorgone et al. | |
| 4,532,641 | A | 7/1985 | Nishimura | |
| 4,539,702 | A | 9/1985 | Oka | 382/7 |
| 4,542,829 | A | 9/1985 | Emery et al. | 209/534 |
| 4,547,896 | A | 10/1985 | Ohtombe et al. | 382/318 |
| 4,553,846 | A | 11/1985 | Hilton et al. | 356/429 |
| 4,556,140 | A | 12/1985 | Okada | 194/4 |
| 4,557,597 | A | 12/1985 | Iwama | 356/71 |
| 4,558,224 | A | 12/1985 | Gober | 250/460.1 |
| 4,559,451 | A | 12/1985 | Curl | 250/560 |
| 4,559,452 | A | 12/1985 | Igaki et al. | |
| 4,563,771 | A | 1/1986 | Gorgone et al. | 382/7 |
| 4,567,370 | A | 1/1986 | Falls | 250/461.1 |
| 4,585,928 | A | 4/1986 | Watanabe | 235/379 |
| 4,587,412 | A | 5/1986 | Apisdorf | 235/449 |
| 4,587,434 | A | 5/1986 | Roes et al. | 250/556 |
| 4,592,090 | A | 5/1986 | Curl et al. | 382/7 |
| 4,593,184 | A | 6/1986 | Bryce et al. | 235/449 |
| 4,611,345 | A | 9/1986 | Ohniski et al. | 382/7 |
| 4,625,870 | A | 12/1986 | Nao et al. | 209/534 |
| 4,628,194 | A | 12/1986 | Dobbins et al. | 235/379 |
| 4,629,382 | A * | 12/1986 | Ueshin | 414/790.5 |
| 4,638,988 | A * | 1/1987 | Kershaw | 271/171 |
| 4,645,936 | A | 2/1987 | Gorgone | 250/556 |
| 4,653,647 | A | 3/1987 | Hashimoto | 209/534 |
| 4,658,289 | A | 4/1987 | Nagano et al. | 358/75 |
| 4,677,682 | A | 6/1987 | Miyaqawa et al. | 382/7 |
| 4,681,229 | A | 7/1987 | Uesaka et al. | 209/534 |
| 4,683,508 | A | 7/1987 | Jeffers et al. | 360/113 |
| 4,690,268 | A | 9/1987 | Ueshin | 198/399 |
| 4,694,963 | A | 9/1987 | Takesako | 209/534 |
| 4,697,071 | A | 9/1987 | Hiraoka et al. | 235/379 |
| 4,700,368 | A | 10/1987 | Munn et al. | 377/8 |
| 4,707,843 | A | 11/1987 | McDonlad et al. | |
| 4,716,456 | A | 12/1987 | Hosaka | |
| 4,733,308 | A | 3/1988 | Nakamura et al. | |
| 4,747,492 | A | 5/1988 | Saito et al. | |
| 4,749,087 | A | 6/1988 | Buttifant | |
| 4,764,976 | A | 8/1988 | Kallin et al. | |
| 4,784,274 | A | 11/1988 | Mori et al. | |
| 4,804,998 | A * | 2/1989 | Miyawaki | 271/258.03 |
| 4,817,176 | A | 3/1989 | Marshall et al. | |
| 4,820,909 | A | 4/1989 | Kawaucki et al. | 235/379 |
| 4,823,393 | A | 4/1989 | Kawakami | 382/7 |
| 4,825,246 | A | 4/1989 | Fukuchi et al. | |
| 4,827,531 | A | 5/1989 | Milford | 382/7 |
| 4,834,230 | A | 5/1989 | Kondo et al. | 194/206 |
| 4,841,358 | A | 6/1989 | Kammato et al. | 358/75 |
| 4,875,670 | A * | 10/1989 | Petersen et al. | 271/265.01 |
| 4,881,268 | A | 11/1989 | Uchida et al. | 382/7 |
| 4,905,840 | A | 3/1990 | Yuge et al. | 209/534 |
| 4,906,988 | A | 3/1990 | Copella | 340/825 |
| 4,908,516 | A | 3/1990 | West | |
| 4,917,371 | A * | 4/1990 | Bastow et al. | 271/245 |
| 4,973,851 | A | 11/1990 | Lee | 250/556 |
| 4,984,280 | A | 1/1991 | Abe | |
| 4,984,692 | A | 1/1991 | Obara | 209/583 |
| 4,985,614 | A | 1/1991 | Pease et al. | 235/440 |
| 4,992,860 | A | 2/1991 | Hamaquchi et al. | 358/75 |
| 4,996,604 | A | 2/1991 | Oqawa et al. | 358/486 |
| 5,012,932 | A | 5/1991 | Omura et al. | 209/534 |
| 5,020,787 | A | 6/1991 | Arikawa | 271/3 |
| 5,027,415 | A | 6/1991 | Hara et al. | 382/135 |
| 5,047,871 | A | 9/1991 | Meyer et al. | 358/486 |
| 5,054,621 | A | 10/1991 | Murphy et al. | 209/534 |
| 5,055,834 | A | 10/1991 | Chiba | 382/135 |
| 5,068,519 | A | 11/1991 | Bryce | 235/449 |
| 5,076,441 | A | 12/1991 | Gerlier | 209/534 |
| 5,105,364 | A | 4/1992 | Kkawamura et al. | 364/478 |
| 5,119,025 | A | 6/1992 | Smith et al. | 324/252 |
| 5,122,754 | A | 6/1992 | Gotaas | 324/676 |
| 5,146,067 | A | 9/1992 | Sloan et al. | 235/381 |
| 5,151,607 | A | 9/1992 | Crane et al. | 250/556 |
| 5,163,672 | A | 11/1992 | Mennie | 271/187 |
| 5,167,313 | A | 12/1992 | Dobbins et al. | 194/317 |
| 5,172,907 | A | 12/1992 | Kalisiak | 271/227 |
| 5,183,142 | A | 2/1993 | Latchinian et al. | 194/206 |
| 5,186,334 | A | 2/1993 | Fukudome et al. | 209/531 |
| 5,199,543 | A | 4/1993 | Kamagami et al. | 194/207 |
| 5,201,395 | A | 4/1993 | Takizawa et al. | 194/206 |

| | | | | | |
|---|---|---|---|---|---|
| 5,207,788 | A | | 5/1993 | Geib et al. | |
| 5,220,395 | A | | 6/1993 | Yamashita et al. | 355/313 |
| 5,232,216 | A | * | 8/1993 | Bybee | 271/228 |
| 5,236,072 | A | | 8/1993 | Cargill | 194/207 |
| 5,240,116 | A | | 8/1993 | Stevens et al. | 209/534 |
| 5,261,518 | A | | 11/1993 | Bryce | 194/207 |
| 5,295,196 | A | | 3/1994 | Raterman et al. | 382/7 |
| 5,297,030 | A | | 3/1994 | Vassigh et al. | 364/405 |
| 5,304,813 | A | | 4/1994 | DeMan | 250/556 |
| 5,308,992 | A | | 5/1994 | Crane et al. | 250/556 |
| 5,309,515 | A | | 5/1994 | Troung et al. | 382/7 |
| 5,341,408 | A | | 8/1994 | Melcher et al. | 377/8 |
| 5,358,088 | A | | 10/1994 | Barnes et al. | 194/206 |
| 5,363,949 | A | | 11/1994 | Matsubayashi | 194/206 |
| 5,367,577 | A | | 11/1994 | Gotaas | 382/135 |
| 5,394,992 | A | | 3/1995 | Winkler | 209/552 |
| 5,397,003 | A | | 3/1995 | Stevens et al. | 209/534 |
| 5,402,895 | A | | 4/1995 | Mikkelsen et al. | |
| 5,408,417 | A | | 4/1995 | Wilder | 364/479 |
| 5,418,458 | A | | 5/1995 | Jeffers | 324/235 |
| 5,430,664 | A | | 7/1995 | Cargill et al. | 364/550 |
| 5,437,357 | A | | 8/1995 | Ota et al. | 385/135 |
| 5,445,277 | A | | 8/1995 | Takemoto et al. | 209/534 |
| 5,465,821 | A | | 11/1995 | Akioka | 194/207 |
| 5,467,405 | A | | 11/1995 | Raterman et al. | 382/135 |
| 5,467,406 | A | | 11/1995 | Graves et al. | 382/135 |
| 5,478,992 | A | | 12/1995 | Hamada et al. | 235/379 |
| D369,984 | S | | 5/1996 | Larsen | D10/97 |
| 5,553,320 | A | | 9/1996 | Matsuura et al. | 235/379 |
| 5,607,040 | A | | 3/1997 | Mathurin, Sr. | 194/207 |
| 5,616,915 | A | | 4/1997 | Simpkins et al. | |
| 5,633,949 | A | | 5/1997 | Graves et al. | 382/135 |
| 5,639,081 | A | | 6/1997 | Hatamachi et al. | 271/177 |
| 5,640,463 | A | | 6/1997 | Csulits | 382/135 |
| 5,652,802 | A | | 7/1997 | Graves et al. | 382/135 |
| 5,657,846 | A | | 8/1997 | Schwartz | |
| 5,680,472 | A | | 10/1997 | Conant | |
| 5,687,963 | A | | 11/1997 | Mennie | |
| 5,692,067 | A | | 11/1997 | Raterman et al. | 382/135 |
| 5,704,491 | A | | 1/1998 | Graves | 209/534 |
| 5,724,438 | A | | 3/1998 | Graves | 382/135 |
| 5,751,840 | A | | 5/1998 | Raterman et al. | |
| 5,790,693 | A | | 8/1998 | Graves et al. | |
| 5,790,697 | A | | 8/1998 | Munro et al. | |
| 5,806,650 | A | | 9/1998 | Mennie et al. | 194/206 |
| 5,815,592 | A | | 9/1998 | Mennie et al. | |
| 5,822,448 | A | | 10/1998 | Graves et al. | 382/135 |
| 5,829,742 | A | * | 11/1998 | Rabindran et al. | 271/158 |
| 5,832,104 | A | | 11/1998 | Graves et al. | 382/135 |
| 5,867,589 | A | | 2/1999 | Graves et al. | 382/135 |
| 5,870,487 | A | | 2/1999 | Graves et al. | |
| 5,875,259 | A | | 2/1999 | Mennie et al. | 382/135 |
| 5,905,810 | A | | 5/1999 | Jones et al. | |
| 5,912,982 | A | | 6/1999 | Munro et al. | 382/135 |
| 5,915,685 | A | * | 6/1999 | Baush et al. | 271/157 |
| 5,917,930 | A | | 6/1999 | Kayani et al. | |
| 5,938,044 | A | | 8/1999 | Weggesser | 209/534 |
| 5,966,456 | A | | 10/1999 | Jones et al. | 382/135 |
| 5,993,132 | A | * | 11/1999 | Harres et al. | 271/148 |
| 6,012,565 | A | | 1/2000 | Mazur | |
| 6,021,883 | A | | 2/2000 | Casanova et al. | 194/217 |
| 6,028,951 | A | | 2/2000 | Raterman et al. | 382/135 |
| 6,074,334 | A | | 6/2000 | Mennie et al. | 493/438 |

FOREIGN PATENT DOCUMENTS

| | | | |
|---|---|---|---|
| EP | 0206675 | B1 | 12/1986 |
| EP | 0253935 | A2 | 1/1988 |
| EP | 0264125 | A1 | 4/1988 |
| EP | 0325364 | A2 | 7/1989 |
| EP | 0338123 | | 10/1989 |
| EP | 0342647 | A3 | 11/1989 |
| EP | 0342647 | A2 | 11/1989 |
| GB | 2061232 | A | 9/1980 |
| GB | 2119138 | | 2/1983 |
| GB | 2190996 | A | 12/1987 |
| JP | 54-71673 | | 6/1979 |
| JP | 54-71674 | | 6/1979 |
| JP | 56-16287 | | 2/1981 |
| JP | 56-136689 | | 10/1981 |
| JP | 61-14557 | | 4/1986 |
| JP | 61-41439 | | 9/1986 |
| WO | WO 87/06041 | | 10/1987 |
| WO | WO 90/07165 | | 6/1990 |
| WO | WO 91/11778 | | 8/1991 |
| WO | WO 92/17394 | | 10/1992 |
| WO | WO 93/23824 | | 11/1993 |
| WO | WO 94/19773 | | 9/1994 |
| WO | WO 96/10800 | | 4/1996 |

OTHER PUBLICATIONS

Glory Brochure "Unstoppable" GFR–100 ReadMaster Currency Discriminator, 2 pages, 8/98.

Glory Brochure "Tank Tough Currency Discriminators" GFR–100 & GFB–700, 2 pages, Aug. 6, 1998.

Glory Brochure "Tank Tough Currency Discriminators" GFR–100 & GFR–S80, 2 pages, Dec. 7, 1999.

Chp. 7 of Mosler CF–420 Cash Management System, Operator's Manual©, 1989.

Currency Systems International/Currency Processing Systems, CPS 300; 4 pages; date: copyr. 1992.

Currency Systems International, Medium Speed Currency Sorting Family, CPS 600 and CPS 900; 4 pages; date: copyr. 1994.

Currency Systems International, Mr. W. Kranister in Conversation With Richard Haycock; pp. 1–5; dated: estimated 1994.

Declaration of Per Torling, 6 page (Mar. 18, 1999).

Description of Currency Systems International's CPS 600 and CPS 900 devices; date: estimated 1994.

Description of Toshiba–Mosler CF–420 Device; estimated 1989.

Drawings of portions of Mosler CF–420 Cash Management System (FIGs. A–C) and description of the same (1989).

Glory GFB–200/210/220/230, Desk–Top Bank Note Counter; 2 pages; date: estimated before Aug. 9, 1994.

Glory GFF–8CF and GFF–8 Desk–Top Currency and Check Counter; cover page; date: estimated Jan. 14, 1994.

Glory GFR–X Banknote Counter with Denomination Recognition; 3 pages; date: estimated Jan. 14, 1994.

Glory GFU–100 Desk–top Currency Fitness Sorter/Counter; 2 pages; date estimated Jan. 14, 1994.

Glory GSA–500 Sortmaster brochure; 4 pages; date: estimated Jan. 14, 1994.

JetScan Currency Scanner/Counter, Model 4060, Operator's Manual by Cummins–Allison (8/91).

JetScan Currency Scanner/Counter Model 4062, Operating Instructions by Cummins–Allison (Nov. 28, 1994).

Mosler Inc. Description "The Mosler/Toshiba CF–420", 1989.

News Product News by Toyocom, "Toyocom Currency Counter Now Reads Denominations" (Sep. 26, 1994) (1 page).

"Offer for Sale of Optical/Magnetic Detection 9/92".

"Sale of Doubles Detection 6/92".

"Sale of Multiple Magnetic Sensitivity Setting 4/93".

Toshiba–Mosler Operator's Manual for CF–420 Cash Settlement System; pps 1 to C–3; copyr. 1989 (See eg. pp. 3–10; 4–10; and 5–7).
Second Translation of JP 61–14457 (Glory).
Translation of JP 54–71674.
First Translation of JP 56–136689.
Second Translation of JP 56–136689 (Glory).
Abstract of JP 60–52454.
Abstract of JP 2–302894.
Abstract of JP 3–98845.
Abstract of JP 3–111991.
Abstract of JP 4–275696.
Abstract of JP 05205436 (Publn. No. 07061417 A publ. Mar. 7, 1995).
Abstract of JP 07042545 (Publn. No. 08217269 A publ Aug. 27, 1996).
Abstract of JP 08298522 (Publn. No. 10143711 A publ May 29, 1998).
Abstract of JP 09071514 (Publn. No. 10269396 A publ Oct. 9, 1998).
AFB Currency Recognition System (1982).
Banking Machine Digest No. 31 (last page of C12 translation has a date of Dec. 5, 1988) (Japanese).
First Translation of Banking Machine Digest No. 31 (C11).
Second Translation of Banking Machine Digest No. 31 (C11) (Glory).
Third Translation of Banking Machine Digest No. 31 (C11).
Billcon D–202/204 Service Manual (cover marked 630229) (Japanese).
Translation of Billcon D–202/204 Service Manual—(C15).
Billcon D–202, D204 Operator's Manual (cover marked 611215) (Japanese).
First Translation of Billcon D–202, D204 Operator's Manual (C17).
Second Translation of Billcon D–202, D204 Operator's Manual (C17) (Glory).
Brochure "DeLa Rue Systems, The processing of money and documents," date: copyr. 1987 (See e.g. 3120 Currency Sorting Machine, p. 3).
Brochure: "GFR–X Banknote Counter with Denomination Recognition", date: Dec. 1994; pages 3.
Brochure of Mosler Model CS 6600 Optical Currency Counter/Sorter, 4 pages, copyr. 1992.
Brochure by Toyocom, "New Currency Counter with Denomination Recognition, Toyocom NS" (Sep. 26, 1994) (1 page).
Cummins–Allison Corp. v. Glory U.S.A., Inc., N.D. Ill. 1998.
Currency Systems International, CPS 1200; 4 pages; date: copyr. 1992.
Glory Instruction Manual for Model GFR–100 Currency Reader Counter, dated Aug. 15, 1995; pages 26.
Glory UF–1D brochure; 2 pages; date: estimated before Aug. 9, 1994.
Glory GSA–500 Sortmaster brochure; 2 pages; dated Jan. 14, 1994.
JetScan Currency Scanner/Counter, Model 4061, Operating Instructions by Cummins–Allison (Apr. 20, 1993).
Mosler CF–420 Cash Management System Operator's Manual, cover, copyright page, and chapter 5 pp. 5–1 through 5–16, copyrighted 1989.
Mosler–Toshiba Currency Sorter CF–400 Series; 4 pages; date: copyr. 1983.
"Sale of Doubles Detection 7/91".
Sale of JetScan Currency Scanner/Counter, Model 4060 (8/91).
Sale of JetScan Currency Scanner/Counter, Model 4061 (Apr. 20, 1993).
Sale of JetScan Currency Scanner/Counter, Model 4062 (Nov. 28, 1994).
"Sale of Magnetic Detection 7/91".
"Sale of Multiple Density Sensitivity Setting 4/93".
Toyocom Currency Counter, Model NS–100, "Operation Guide (Preliminary)" (Jun. 13, 1995).
First Translation of JP 61–14557.
Translation of JP 54–71673.
Translation of JP 61–41439.
Translation of JP 56–16287.
Billcon Brochure: Note Counter with Detection K–100 series.
CSI, Inc. Web Page: CashCat Desktop Sorter and Specifications.
CSI, Inc. Web Page: CPS 300–600 and Specifications.
CSI, Inc. Web Page: CPS 900 and Specifications.
CSI, Inc. Web Page: CPS 1200–1500–1800 and Specifications.
Mosler Brochure: TouchSort Currency Processing System—One Touch One Pass One Solution.
Toyocom Brochure: NC–50 Currency Counter.
Toyocom Brochure: NS–200 Currency Recognizer.

* cited by examiner

CURRENCY HANDLING SYSTEM HAVING MULTIPLE OUTPUT RECEPTACLES

FIELD OF THE INVENTION

The present invention relates generally to the field of currency handling systems and, more particularly, to a multi-pocket currency handling system for discriminating, authenticating, and/or counting currency bills.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly identifying, discriminating, and counting multiple currency denominations and then delivering the sorted currency bills into a multitude of output compartments. Many of these high end machines are extremely large and expensive such that they are commonly found only in large institutions. These machines are not readily available to businesses which have monetary and space budgets, but still have the need to process large volumes of currency. Other high end currency handling machines require their own climate controlled environment which may place even greater strains on businesses having monetary and space budgets.

Currency handling machines typically employ magnetic sensing or optical sensing for denominating and authenticating currency bills. The results of these processes determines to which output compartment a particular bill is delivered to in a currency handling device having multiple output receptacles. For example, ten dollar denominations may be delivered to one output compartment and twenty dollar denominations to another, while bills which fail the authentication test are delivered to a third output compartment. Unfortunately, many prior art devices only have one output compartment which can be appropriately called a reject pocket. Accordingly, in those cases, the reject pocket may have to accommodate those bills which fail a denomination test or authentication test. As a result, different types of "reject" bills are stacked upon one another in the same output compartment leaving the operator unknowing as to which of those bills failed which tests.

Many prior art large volume currency handling devices which positively transport the currency bills through the device are susceptible to becoming jammed. And many of these machines are difficult to un-jam because the operator must physically remove the bill from the device. If necessary, the operator can often manipulate a hand-crank to manually jog the device to remove the bills. Then, the operator must manually turn the hand crank to flush out all the bills from within the system before the batch can be reprocessed. Further compounding the problem in a jam situation is that many prior art devices are not equipped to detect the presence of a jam. In such a situation, the device continues to operate until the bills pile up and the jam is so severe that the device is forced to physically halt. This situation can cause physical damage to both the machine and the bills. Often, a jam ruins the integrity of the count and/or valuation of the currency bills so that the entire batch must be reprocessed.

Weight is another draw-back of prior art high-volume currency handling machines. In part, the weight of these machines is due to the heavy machinery used. For example, some machines contain large cast iron rails on which apparatuses ride to push currency bills down into the storage compartments. Unfortunately, the increased weight of these machines often translates into increased costs associated with the machine.

Another disadvantage to some prior art currency handling devices is the manner of feeding bills into the device. Many prior art devices only have one advance mechanism so the operator of the device can only process one stack of bills at a time before reloading the machine. Alternatively, the operator can attempt to simultaneously manipulate the stack of bills currently being processed, a new stack of bills, and the feeder mechanism.

SUMMARY OF THE INVENTION

According to one embodiment of the present invention, there is provided a multiple output receptacle currency handling device for receiving a stack of currency bills and rapidly processing all the bills in the stack. One aspect of the present invention is directed to an apparatus for transferring items from a first compartment to a second compartment. The apparatus comprises a plunger assembly having a paddle, an arm, a gate, and a lever. The arm is hingedly connected to the plunger assembly. The gate is disposed between the first compartment and the second compartment, and has an open position and a closed position. The lever extends from the gate, and is in a first position when the gate is in the closed position and in a second position when the gate is in the open position. The gate moves from the closed position to the open position when the paddle moves against the gate or documents stacked upon the gate while descending from the first compartment to the second compartment. The arm moves the lever from the second position to the first position to move the gate from the open position to the closed position when the paddle ascends from the second compartment to above the first compartment.

The above summary of the present invention is not intended to represent each embodiment, or every aspect, of the present invention. Additional features and benefits of the present invention will become apparent from the detail description, figures, and claim set forth below.

BRIEF DESCRIPTION OF THE DRAWINGS

Other objects and advantages of the invention will become apparent upon reading the following detailed description in conjunction with the drawings in which:

FIG. 17*a* is a rear view of a storage cassette sized to accommodate United States currency documents according to one embodiment of the document handling device of the present invention;

DETAILED DESCRIPTION OF THE ILLUSTRATED EMBODIMENTS

Figure 1A:
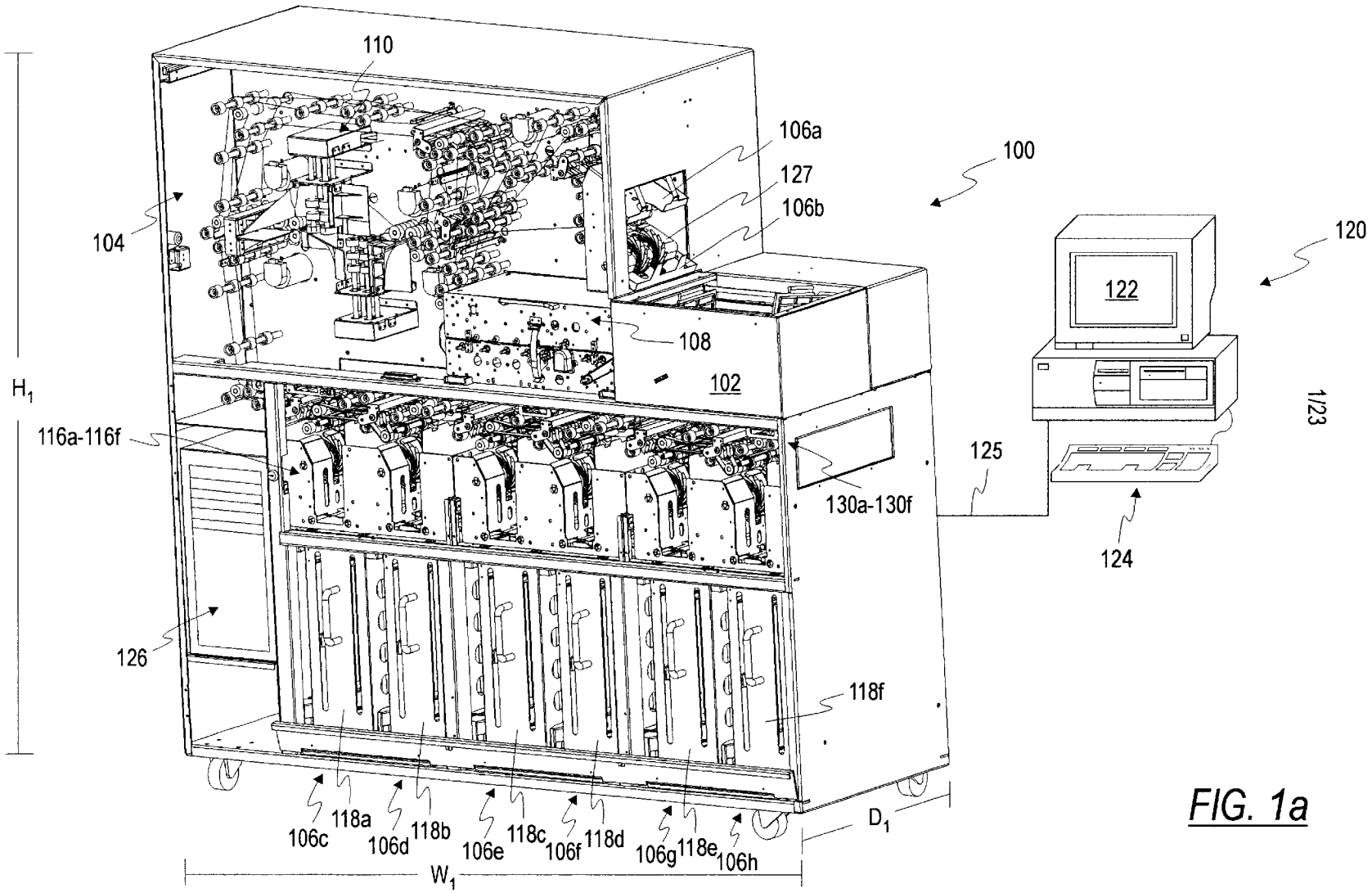
FIG. 1*a* is a perspective view of a document handling device according to one embodiment of the invention.
Figure 1B:
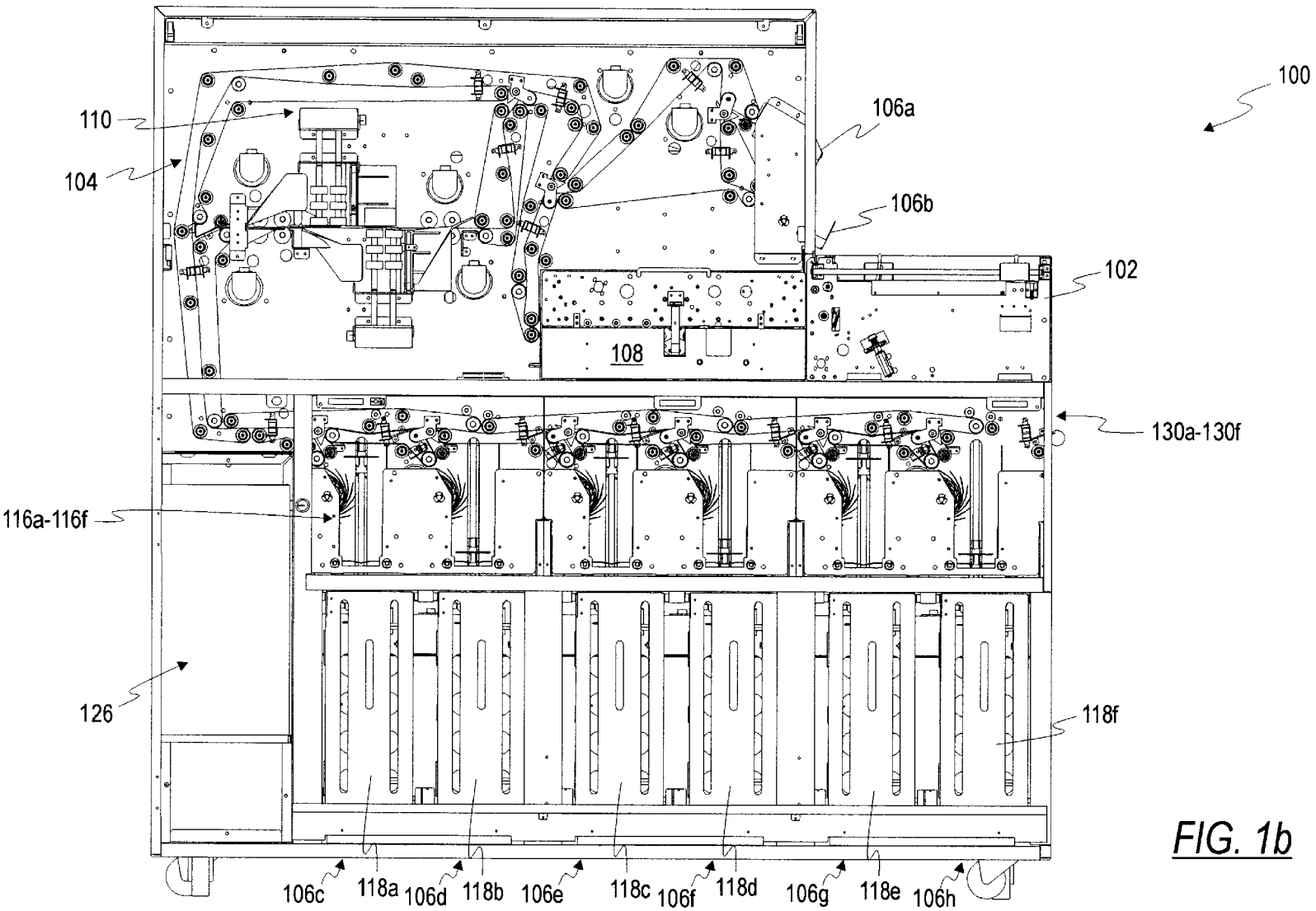
FIG. 1*b* is a front view of a document handling device according to one embodiment of the invention.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*–106*h*, which may include upper output receptacles 106*a*, 106*b*, as well as lower output receptacles 106*c*–106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute.

In the illustrated embodiment, interposed in the bill transport mechanism 104, intermediate the bill evaluation region 108 and the lower output receptacles 106*c*–106*h* is a bill facing mechanism designated generally by reference numeral 110. The bill facing mechanism is capable of rotating a bill 180° so that the face position of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The leading edge of the bill remains constant while the bill is being rotated 180° by the facing mechanism 110. The decision may be taken to send a bill to the facing mechanism 110 when the selected mode of operation or other operator instructions call for maintaining a given face position of bills as they are processed by the currency handling device 100. For example, it may be desirable in certain circumstances for all of the bills ultimately delivered to the lower output receptacles 106*c*–106*h* to have the bill surface bearing the portrait of the president facing up. In such embodiments of the currency handling device 100, the bill evaluation region 108 is capable of determining the face position of a bill, such that a bill not having the desired face position can first be directed to the facing mechanism 110 before being delivered to the appropriate output receptacle 106. Further details of a facing mechanism which may be utilized for this purpose are disclosed in commonly-owned, co-pending U.S. application Ser. No. 09/181,254, entitled "Document Facing Method and Apparatus" which was filed on Oct. 28, 1998, incorporated herein by reference in its entirety, which may be employed in conjunction with the present invention such as the device illustrated in FIGS. 1*a* and 1*b*. Other alternative embodiments of the currency handling device 100 do not include the facing mechanism 110.

The currency handling device 100 in FIG. 1*a* may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*–106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination; accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one-hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*–106*h*. Those bills that were determined not to be authentic, suspect bills, would be delivered to the second upper output receptacle 106*b*. A multitude of user defined modes are disclosed by co-pending U.S. patent application Ser. No. 08/916,100 entitled "Multi-Pocket Currency Discriminator" which was filed on Aug. 21, 1997, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified note is flagged and "presented" in one of the output receptacles 106*a*–106*h*, that is, the transport mechanism 104 is stopped so that the unidentified bill is located at a predetermined position within one of the output receptacles 106*a*–106*h*, such as being the last bill transported to one of the output receptacles. Such criteria can include denominating information, authenticating information, information indicative of the bill's series, or other information the evaluation region 108 is attempting to obtain pursuant to a mode of operation. Which output receptacles 106*a*–106*h* the flagged bill is presented in may be determined by the user according to a selected mode of operation. For example, where the unidentified bill is the last bill transported to an output receptacle 106*a*–106*h*, it may be positioned within a stacker wheel or positioned at the top of the bills already within the output receptacle 106*a*–106*h*. While unidentified bills may be transported to any output receptacles 106*a*–106*h*, it may be more convenient for the operator to have unidentified bills transported to one of the upper output receptacles 106*a,b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*–106*h* a flagged bill is presented.

The currency handling device 100 may be designed to continue operation automatically when a flagged bill is removed from the upper output receptacle 106*a,b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a,b* until the batch of currency bills currently being processed is completed or the output receptacle 106*a,b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*–106*h*, respectively. Upon detection of the first British pound note, the currency handling device 100 may halt operation allowing the operator to empty the lower output receptacles 106*c*–106*h* and to make any spatial adjustments necessary to accommodate the British currency. A multitude of modes of operation are described in conjunction with bill flagging, presenting, and/or transport halting in commonly owned, co-pending U.S. patent application Ser. No. 08/916,100 entitled "Method and Apparatus for Document Processing" which was filed on May 28, 1997, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*–106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*, 106*b* are equipped with a stacker wheel. In such an embodiment both the upper output receptacles 106*a,b* may also function as the lower output receptacle 106*c*–106*h* allowing a number of bills to be stacked therein.

Figure 2A:
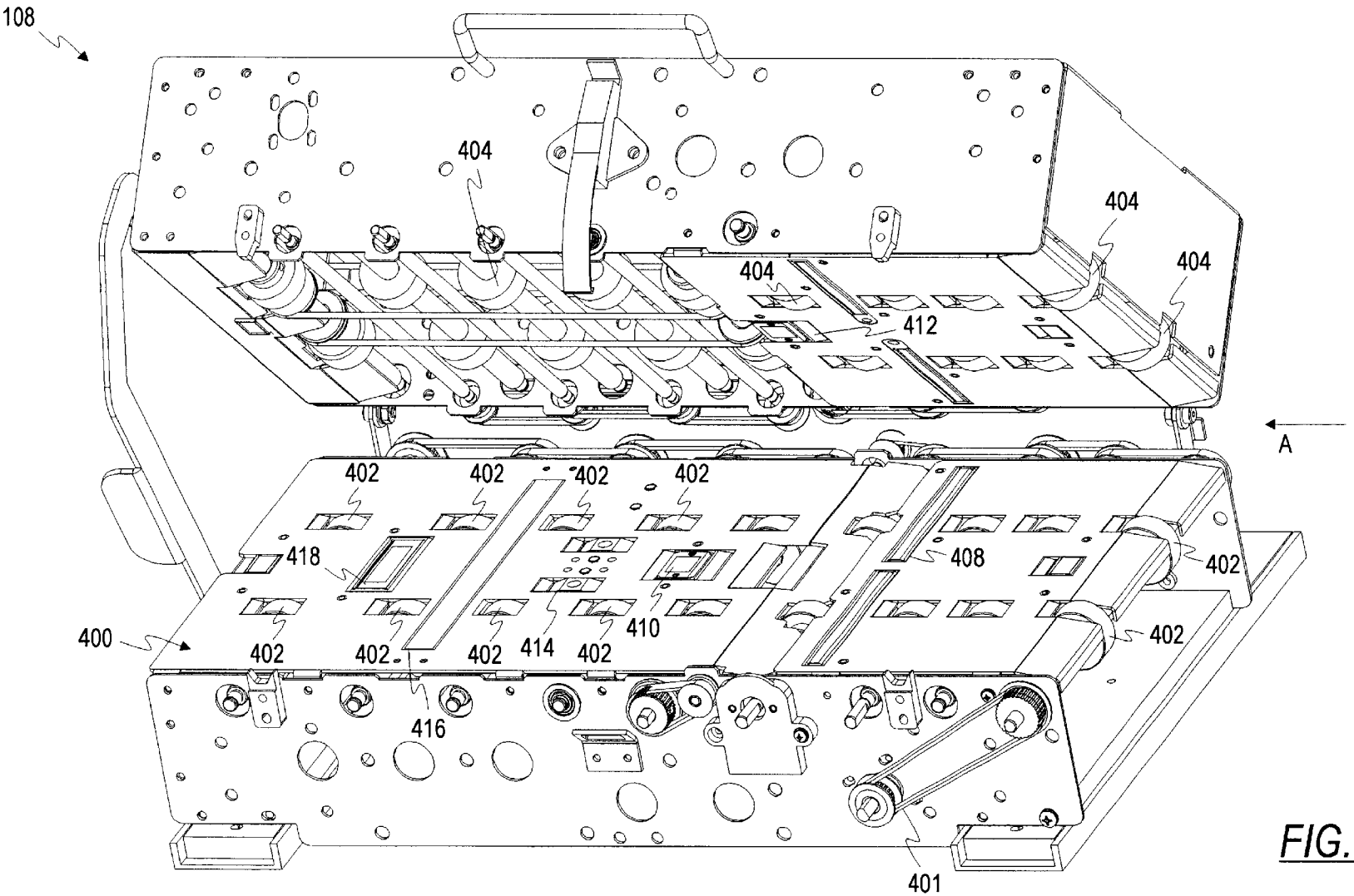
FIG. 2*a* is a perspective view of an evaluation region according to one embodiment of the document handling device of the present invention.
Figure 2B:
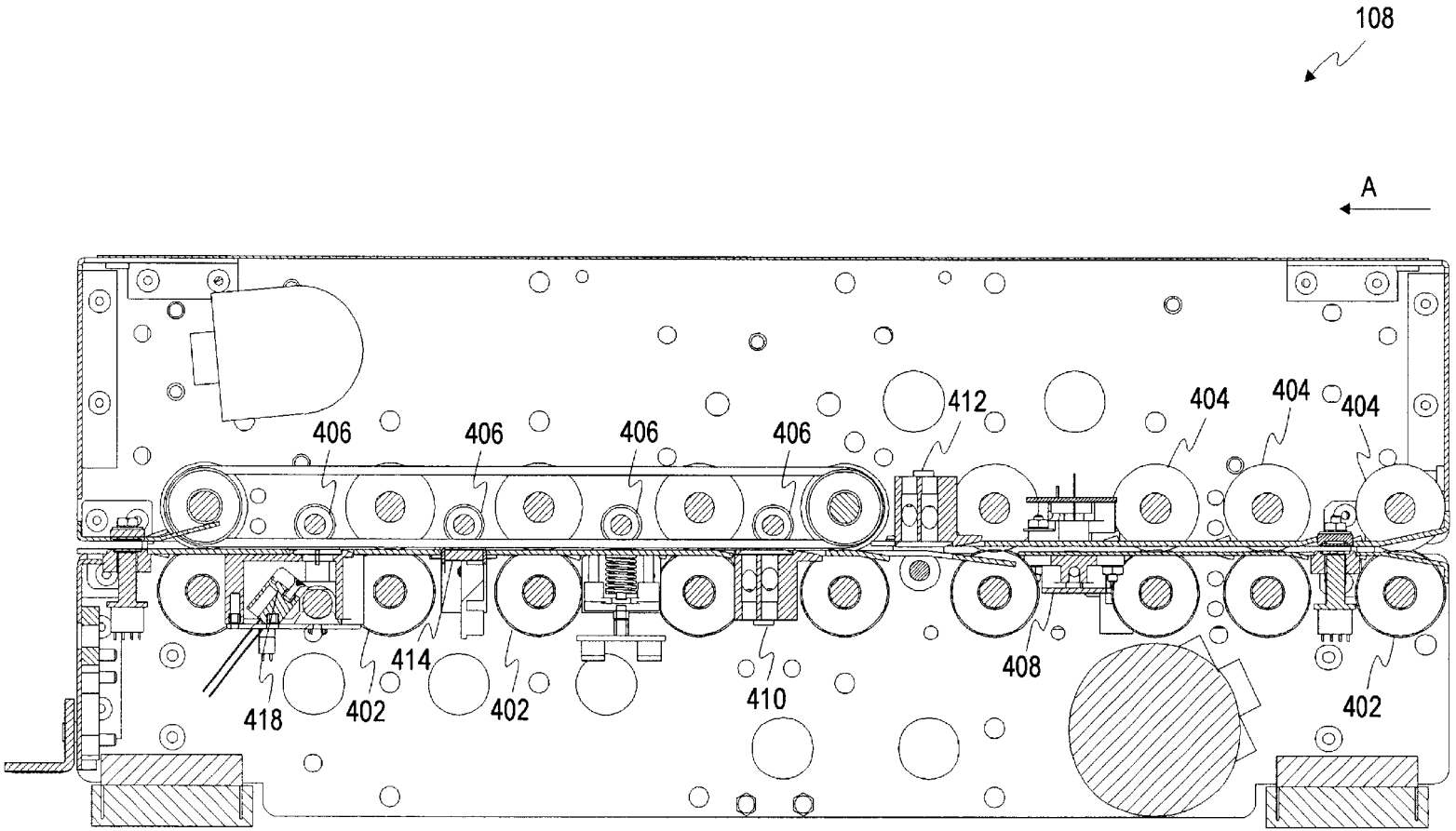
FIG. 2*b* is a side view of an evaluation region according to one embodiment of the document handling device of the present invention.
Figure 3A:
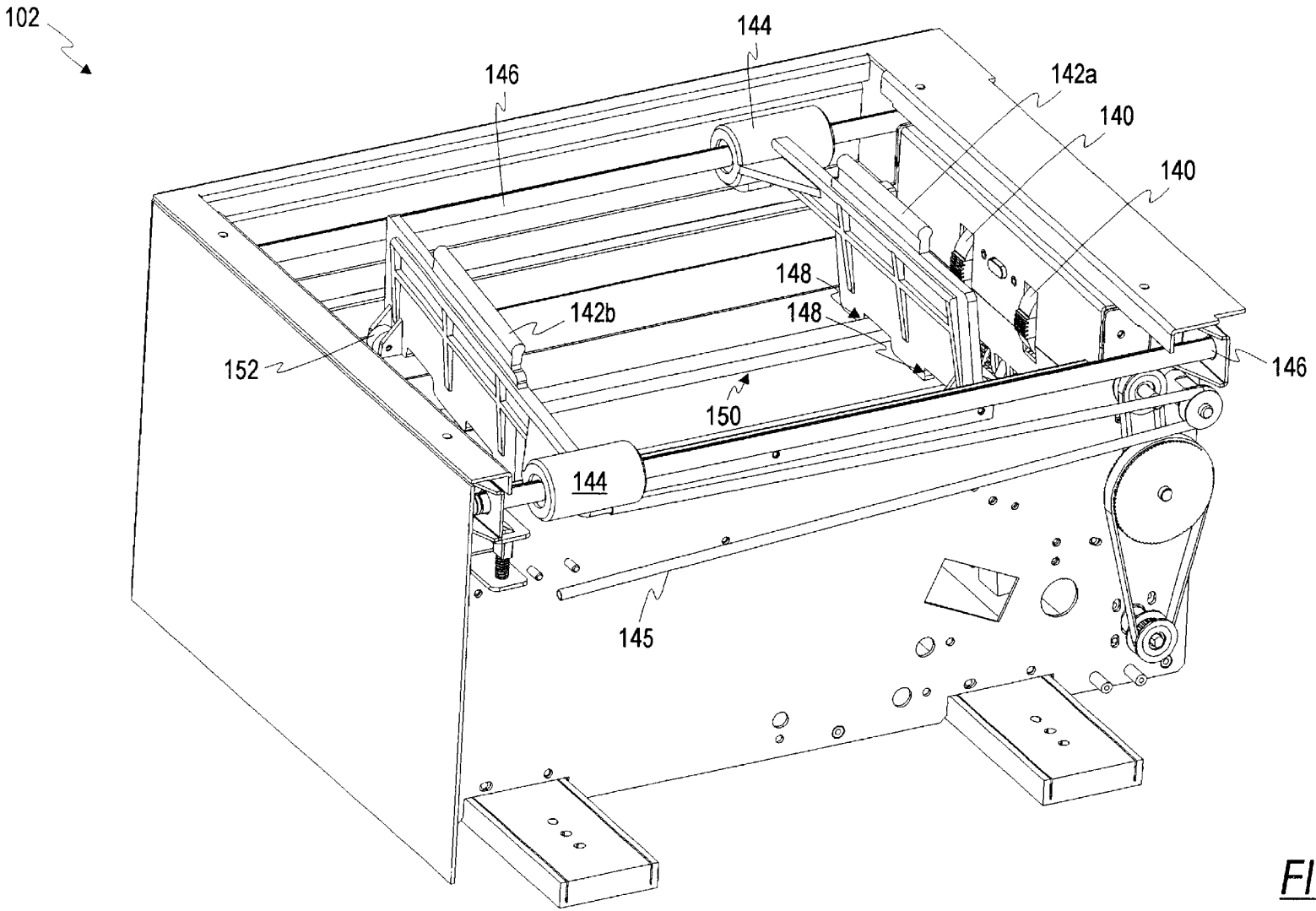
FIG. 3*a* is a perspective view of an input receptacle according to one embodiment of the document handling device of the present invention.
Figure 3B:
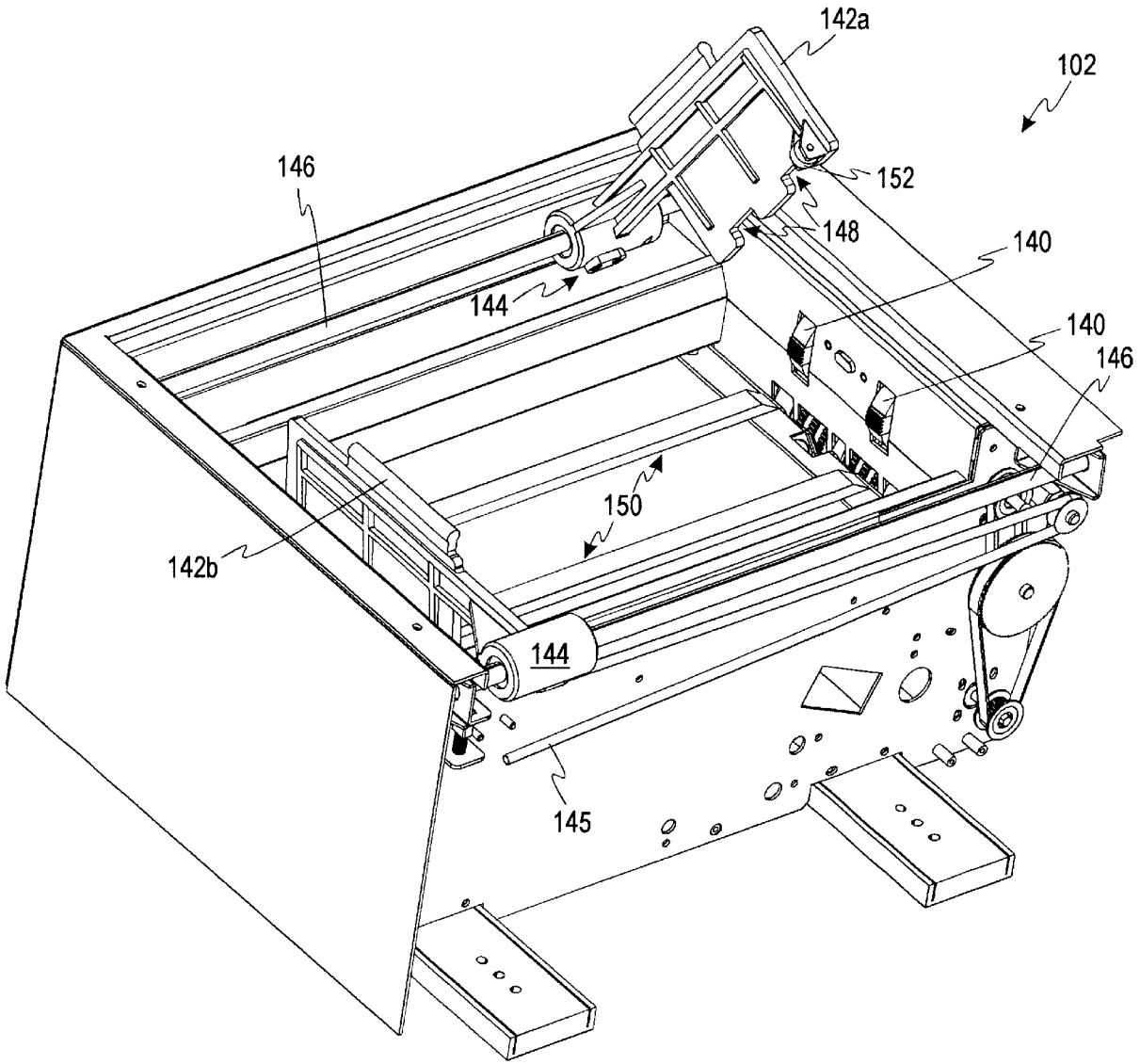
FIG. 3*b* is another perspective view of an input receptacle according to one embodiment of the document handling device of the present invention.
Figure 3C:
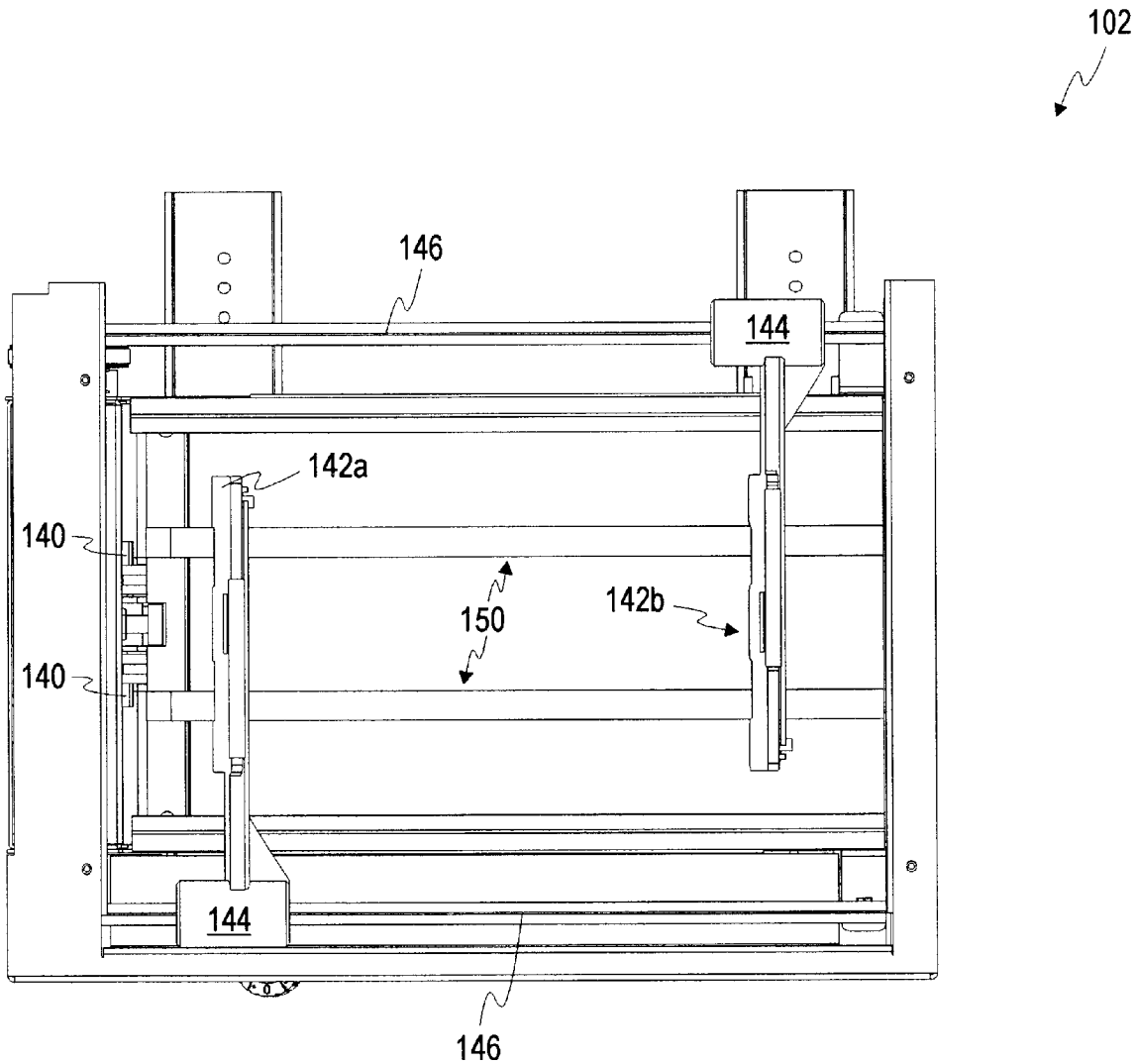
FIG. 3*c* is a top view of an input receptacle according to one embodiment of the document handling device of the present invention.
Figure 3D:
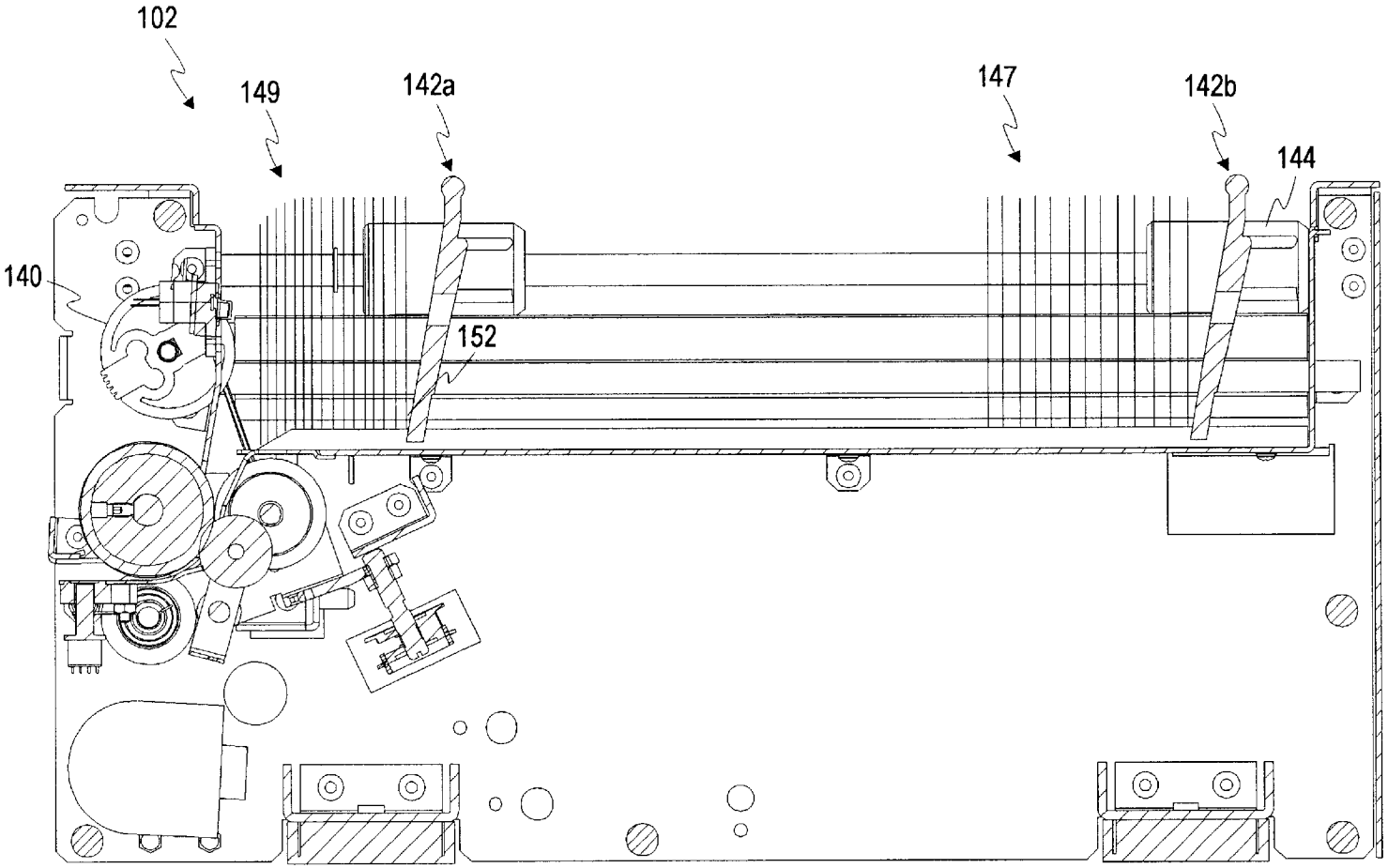
FIG. 3*d* is a side view of an input receptacle according to one embodiment of the document handling device of the present invention.

FIGS. 2*a* and 2*b* illustrate the evaluation region 108 according to one embodiment of the currency handling system 100. The evaluation region can be opened for service, access to sensors, clear bill jams, etc. as shown in FIG. 2*a*. The characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbability, transmissivity, electrical conductivity, etc. The evaluation region 108 may employ a variety of detection means including, but not limited to, a size detection and density sensor 408, a lower 410 and an upper 412 optical scan head, a single or multitude of magnetic sensors 414, a thread sensor 416, and an ultraviolet/fluorescent light scan head 418. These detection means and a host of others are disclosed in commonly owned, co-pending U.S. patent application Ser. No. 08/916,100 entitled "Multi-Pocket Currency Discriminator," incorporated by reference above.

The direction of bill travel through the evaluation region 108 is indicated by arrow A. The bills are positively driven along a transport plate 400 through the evaluation region 108 by means of a transport roll arrangement comprising both driven rollers 402 and passive rollers 404. The rollers 402 are driven by a motor (not shown) via a belt 401. Passive rollers 404 are mounted in such a manner as to be free-wheeling about their respective axis and biased into counter-rotating contact with the corresponding driven rollers 402. The driven and passive rollers 402, 404 are mounted so that they are substantially coplanar with the transport plate 400. The transport roll arrangement also includes compressible rollers 406 to aid in maintaining the bills flat against the transport plate 400. Maintaining the bill flat against the transport plate 400 so that the bill lies flat when transported past the sensors enhances the overall reliability of the evaluation processes. A similar transport arrangement is disclosed in commonly-owned U.S. Pat. No. 5,687,963 entitled "Method and Apparatus for Discriminating and Counting Documents," which is incorporated herein by reference in its entirety.

Referring now to FIGS. 3*a*–3*d*, the input receptacle 102 of the currency handling device 100 is illustrated. A feeder mechanism such as a pair of stripping wheels 140 aid in feeding the bills in seriatim to the transport mechanism 104 which first carries the bills through the evaluation region 108. According to one embodiment, the input receptacle 102 includes at least one spring-loaded feeder paddle 142*a* which is pivotally mounted, permitting it to be pivoted upward and drawn back to the rear of a stack of bills placed in the input receptacle 102 so as to bias the bills towards the evaluation region 108 via the pair of stripping wheels 140. The paddle 142*a* is coupled to an advance mechanism 144 to urge the paddle 142*a* towards the stripping wheels 140. In the illustrated embodiment, motion is imparted to the advance mechanism via a spring 145. In other alternative embodiments, the advance mechanism 144 is motor driven. The advance mechanism 144 is slidably mounted to a shaft 146. The advance mechanism 144 also constrains the paddle 142*a* to a linear path. The advance mechanism 144 may contain a liner bearing (not shown) allowing the paddle 142*a* to easily slide along the shaft 146. In the embodiment illustrated, the paddle 142*a* may also contain channels 148 to aid in constraining the paddle 142*a* to a linear path along a pair of tracks 150. The paddle 142*a* may additionally include a roller 152 to facilitate the movement of the paddle 142*a*.

In the embodiment illustrated in FIGS. 3*a*–3*d*, a second paddle 142*b* is provided such that a second stack of bills 147 may be placed in the input receptacle 102 behind a first group of bills 149, while the first group of bills 149 is being fed into the currency handling device 100. Thus, the two feeder paddles 142*a* and 142*b* may be alternated during processing in order to permit multiple stacks of currency bills to be loaded into the input receptacle 102. In such an embodiment, the operator would retract paddle 142*a* and place a stack of bills into the input receptacle. Once inside the input receptacle, the operator would place the paddle 142*a* against the stack of bills so that the paddle 142*a* biases the stack of bills towards the pair of stripper wheels 140. The operator could then load a second stack of bills into the input receptacle 102 by retracting the second paddle 142*b* and placing a stack of bills in the input receptacle between the paddles 142*a* and 142*b*. The second paddle 142*b* urges the second stack of bills up against the backside of the first paddle 142*a*. The operator can then upwardly rotate the first paddle 142*a* thus combining the two stacks. The first paddle 142*a* is then retracted to the rear of the input receptacle and the process can be repeated. The two paddle input receptacle allows the operator to more easily continuously feed stacks of bills to the currency handling device 100. In devices not having two feeder paddles, the operator is forced to awkwardly manipulate the two stacks of bills and the advance mechanism. Alternatively, the operator may wait for the stack of bills to be processed out of the input receptacle to add another stack; however, waiting to reload until each stack is processed adds to the total time to process a given amount of currency.

Figure 4:
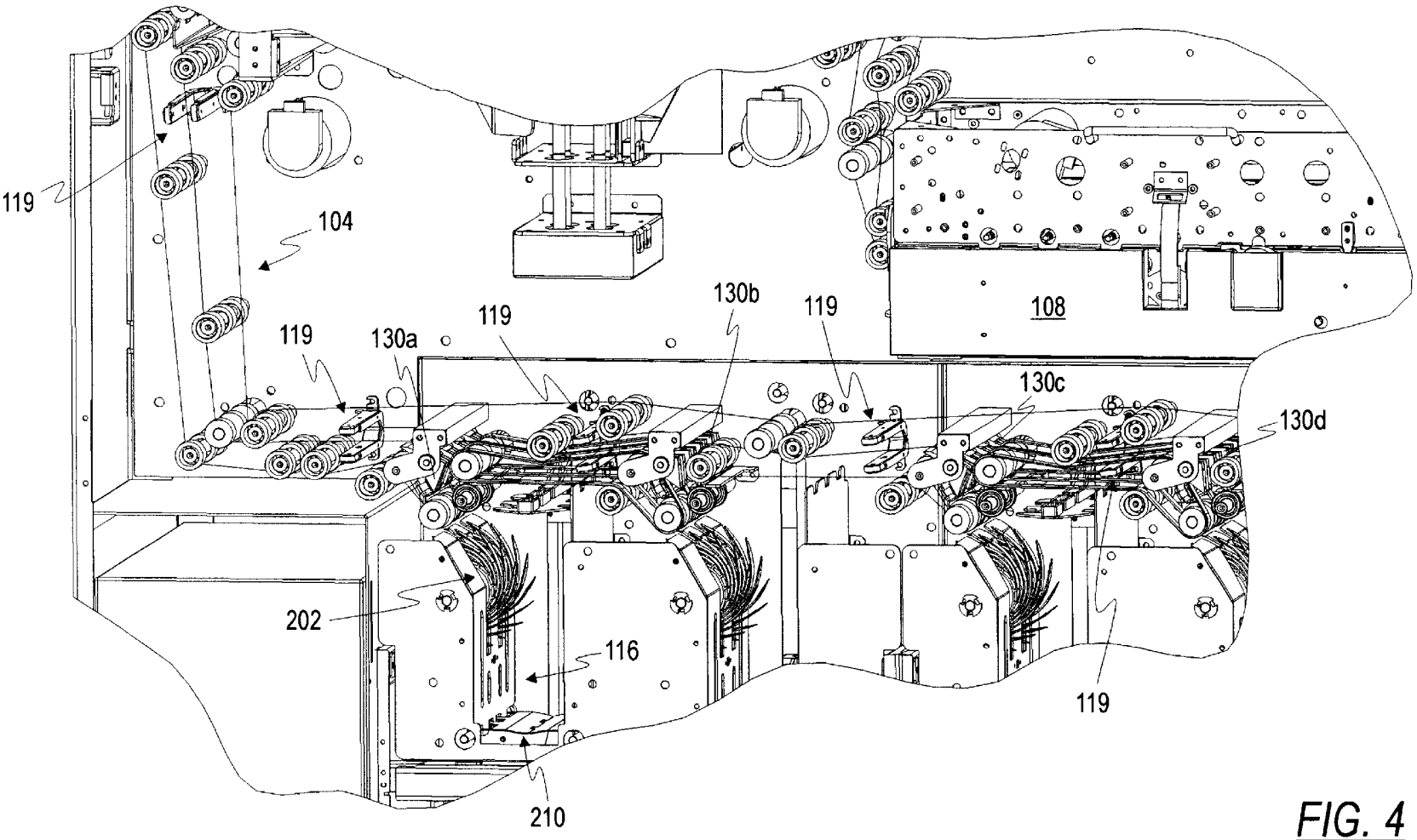
FIG. 4 is a perspective view of a portion of a transportation mechanism according to one embodiment of the present invention.

Referring to FIG. 4, a portion of the transport mechanism 104 and diverters 130*a*–130*d* are illustrated. A substantial portion of the transport path of the currency handling device 100 positively grips the bills during transport from the pair of stripping wheels 140 through the point where bills are delivered to upper output receptacle 106*a* or are delivered to the stacker wheels 202 of output receptacles 106*b*–106*h*. The positive grip transport path of the currency handling device 100 is less costly and weighs less than the vacuum transport arrangements of prior currency processing devices.

The transport mechanism 104 is electronically geared causing all sections to move synchronously from the evaluation region 108 through the point where the bills are delivered to the output receptacles 106. Multiple small motors are used to drive the transport mechanism 104. Using multiple small, less costly motors is more efficient and less costly than a single large motor. Further, less space is consumed enabling the currency handling device 100 to be more compact. Electronically gearing the transport mechanism 104 enables a single encoder to monitor bill transportation within the currency handling system 100. The encoder is linked to the bill transport mechanism 104 and provides input to a processor to determine the timing of the operations of the currency handling device 100. In this manner, the processor is able to monitor the precise location of the bills as they are transported through the currency handling device 100. This process is termed "flow control." Input from additional sensors 119 located along the transport mechanism 104 of the currency handling device 100 enables the processor to continually update the position of a bill within the device 100 to accommodate for bill slippage. When a bill leaves the evaluation region 108 the processor expects the bill to arrive at the diverter 130*a* corresponding to the first lower output receptacle 106*c* after a precise number of encoder counts. Specifically, the processor expects the bill to flow past each sensor 119 positioned along the transport mechanism 104 at a precise number of encoder counts. If the bill slips during transport but passes a sensor 119 later within an acceptable number of encoder counts the processor updates or "re-queues" the new bill position. The processor calculates a new figure for the time the bill is expected to pass the next sensor 119 and arrive at the first diverter 130*a*. The processor activates one of the diverters 130*a*–*f* to direct the bill into the appropriate corresponding lower output receptacle 106*c*–106*h* when the sensor 119 immediately preceding the diverter 130 detects the passage of the bill to be directed into the appropriate lower output receptacle 106*c*–*h*.

The currency handling device 100 also uses flow control to detect jams within the transport mechanism 104 of the device 100. When a bill does not reach a sensor 119 within in the calculated number of encoder counts plus the maximum number of counts allowable for slippage, the processor suspends operation of the device 100 and informs the operator via the display/user-interface 122 that a jam has occurred. The processor also notifies the operator via the display/user-interface 122 of the location of the jam by indicating the last sensor 119 that the bill passed and generally the approximate location of the jam in the system. If the operator cannot easily remove the bill without damage, the operator can then electronically jog the transport path in the forward or reverse direction via the control unit 120 so that the jammed bill is dislodged and the operator can easily remove the bill from the transport path. The operator can then flush the system causing the transport mechanism 104 to deliver all of the bills currently within the transport path of the currency handling device 100 to one of the output receptacles 106. In an alternative embodiment, the user of the currency handling device 100 would have the option when flushing the system to first have the bills already within the escrow regions 116*a*–116*f* to be delivered to the respective lower storage cassettes 106*c*–106*h* so that those bills may be included in the aggregate value data for the bills being processed. The bills remaining in the transport path 104 would then be delivered to a predetermined escrow region 116 where those bills could be removed and reprocessed by placing those bills in the input receptacle 102.

Utilizing flow control to detect jams is more desirable than prior art currency evaluation machines which do not detect a jam until a sensor is actually physically blocked. The latter method of jam detection permits bills to pile up while waiting for a sensor to become blocked. Bill pile-up is problematic because it may physically halt the machine before the jam is detected and may cause physical damage to the bills and the machine. In order to remedy a jam in a prior art machine, the operator must first manually physically dislodge the jammed bills. The operator must then manually turn a hand crank which advances the transport path until all bills within the transport path are removed. Moreover, because the prior art devices permit multiple bills to pile up before a jam is detected, the integrity of the process is often ruined. In such a case, the entire stack of bills must be reprocessed.

Referring back to FIG. 1*a*, the illustrated embodiment of the currency handling device 100 includes a total of six lower output receptacles 106*c*–106*h*. More specifically, each of the lower output receptacles 106*c*–106*h* includes a first portion designated as an escrow compartment 116*a*–116*f* and a second portion designated as a storage cassette 118*a*–118*f*. Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*–106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise two lower output receptacles. In other alternative embodiments, several modular units may be added at one time to the currency handling device 100.

A series of diverters 130*a*–130*f*, which are a part of the transportation mechanism 104, direct the bills to one of the lower output receptacles 106*c*–106*h*. When the diverters 130 are in an upper position, the bills are directed to the adjacent lower output receptacle 106. When the diverters 130 are in a lower position, the bills proceed in the direction of the next diverter 130.

Figure 5:
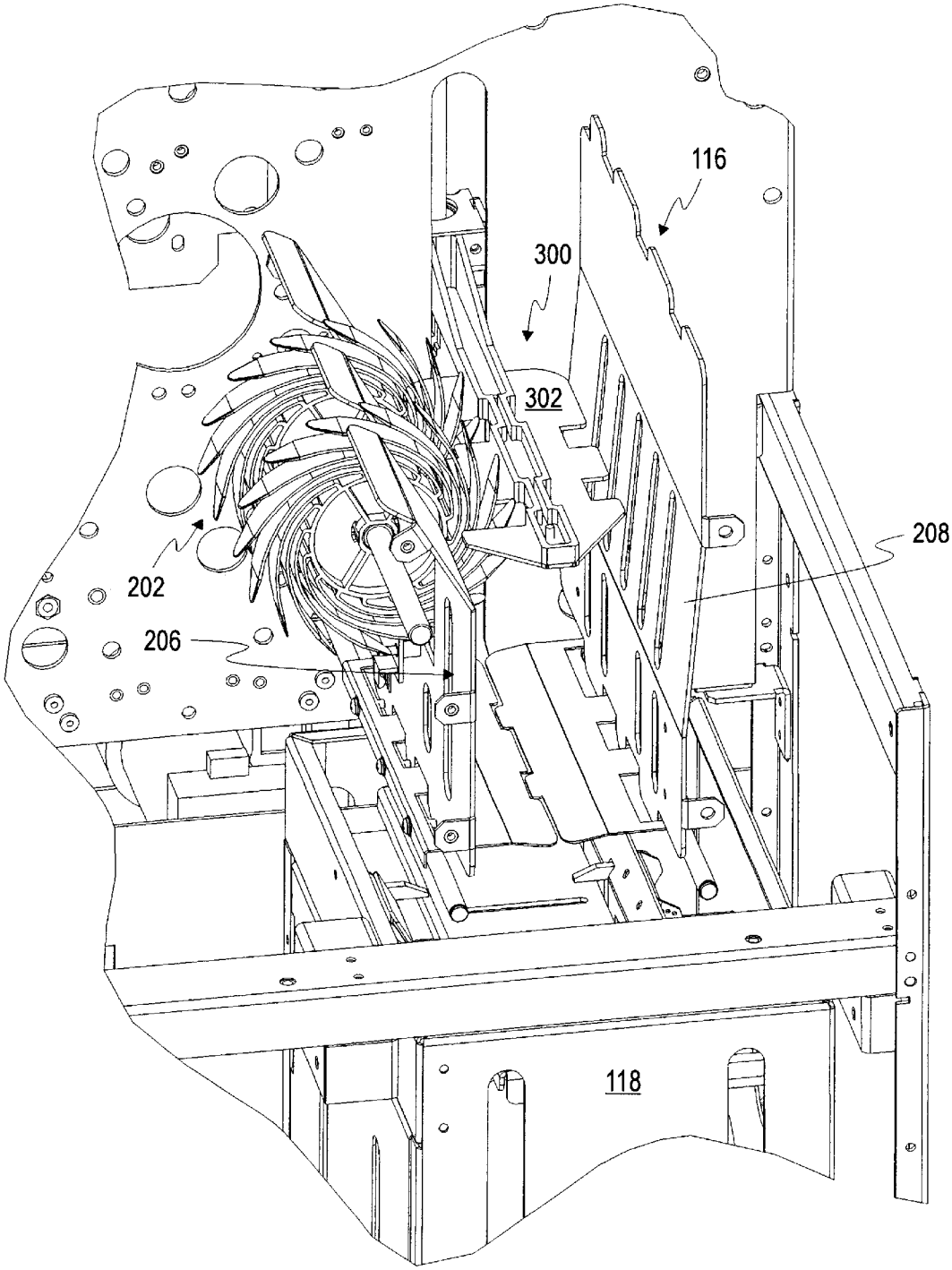
FIG. 5 is a front perspective view of an escrow compartment, a plunger assembly, and a storage cassette according to one embodiment of the document handling device of the present invention.

The vertical arrangement of the lower output receptacles 106*c*–106*h* is illustrated in FIG. 5. The escrow compartment 116 is positioned above the storage cassette 118. In addition to the escrow compartment 116 and the storage cassette 118, each of the lower output receptacles 106*c*–106*h* contains a plunger assembly 300. The plunger assembly 300 is shown during its decent towards the storage cassette 118.

Figure 6:
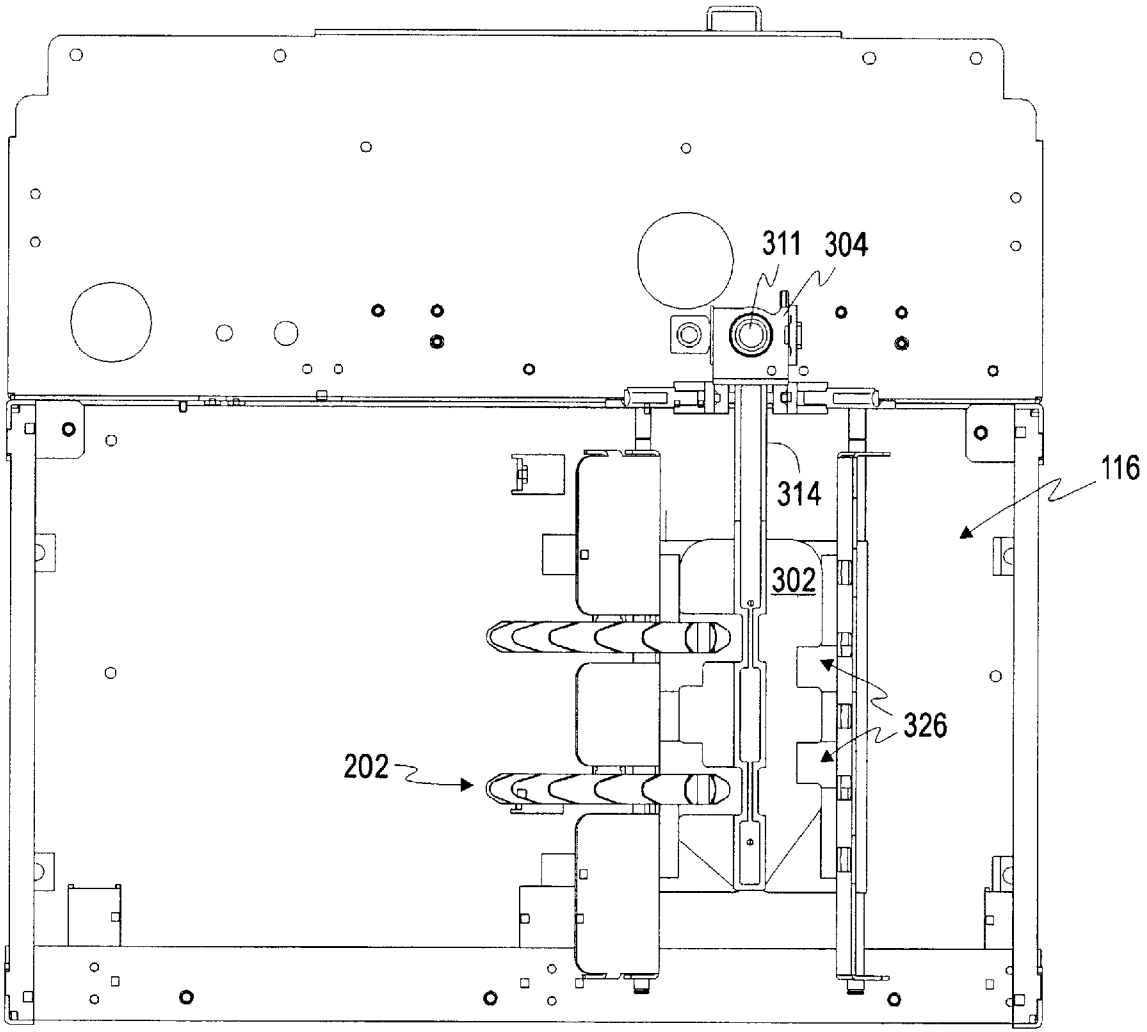
FIG. 6 is a top view of an escrow compartment and plunger assembly according to one embodiment of the document handling device of the present invention.
Figure 7:
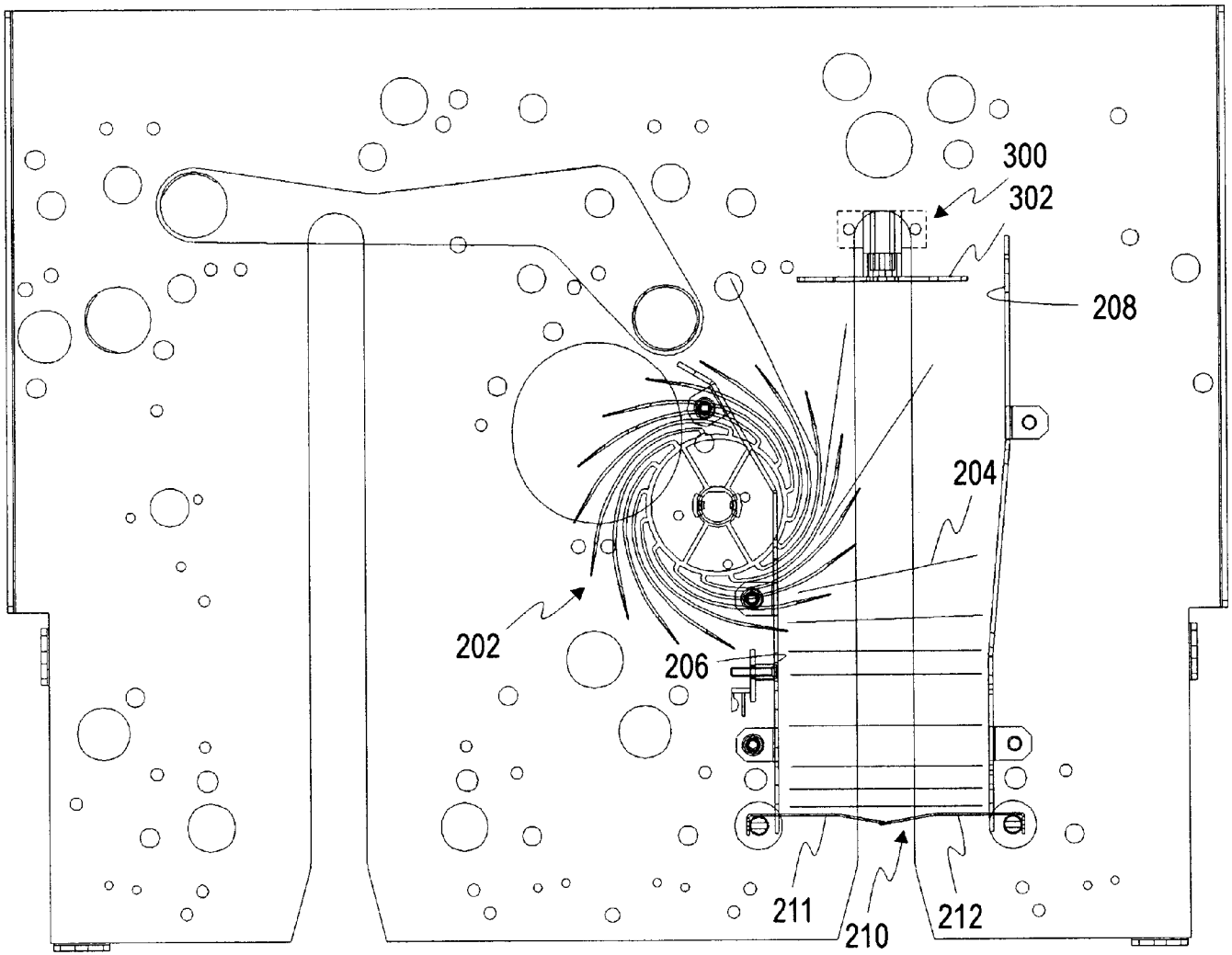
FIG. 7 is a front view of an escrow compartment and plunger assembly according to one embodiment of the document handling device of the present invention.

Referring now to FIGS. 6 and 7, one of the escrow compartments 116 of the lower output receptacles 106*c*–106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. Below the gate 210 is the storage cassette 118 (not shown in FIGS. 6 and 7).

Figure 8:
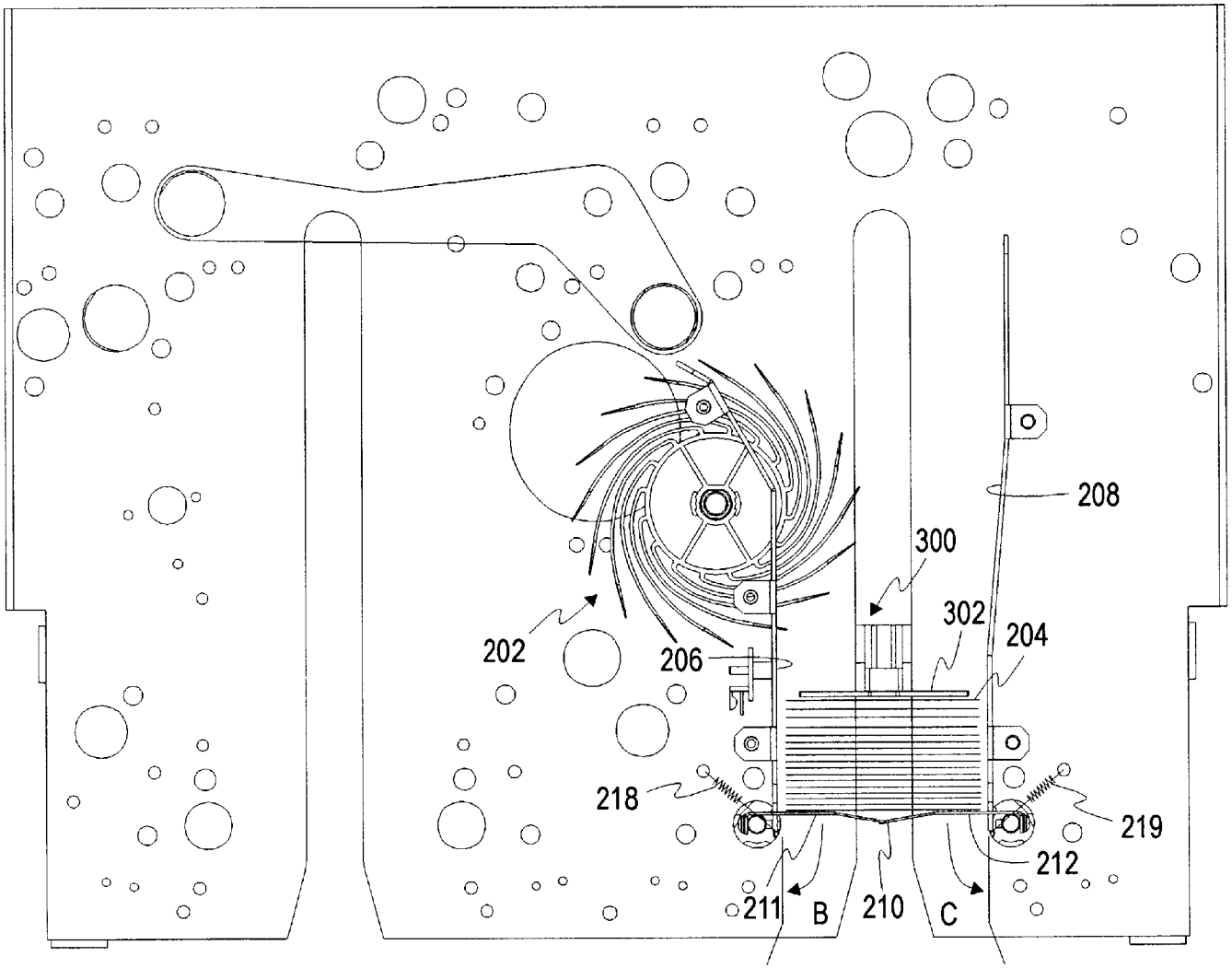
FIG. 8 is another front view of an escrow compartment and plunger assembly according to one embodiment of the document handling device of the present invention.

FIG. 8 illustrates the positioning of the paddle 302 when transferring a stack of bills from the escrow compartment 116 to the storage cassette 118. When the paddle descends upon the stack of bills 204 it causes shutters 211, 212 to quickly rotate in the directions referred to by arrows B and C, respectively; thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Figure 9:
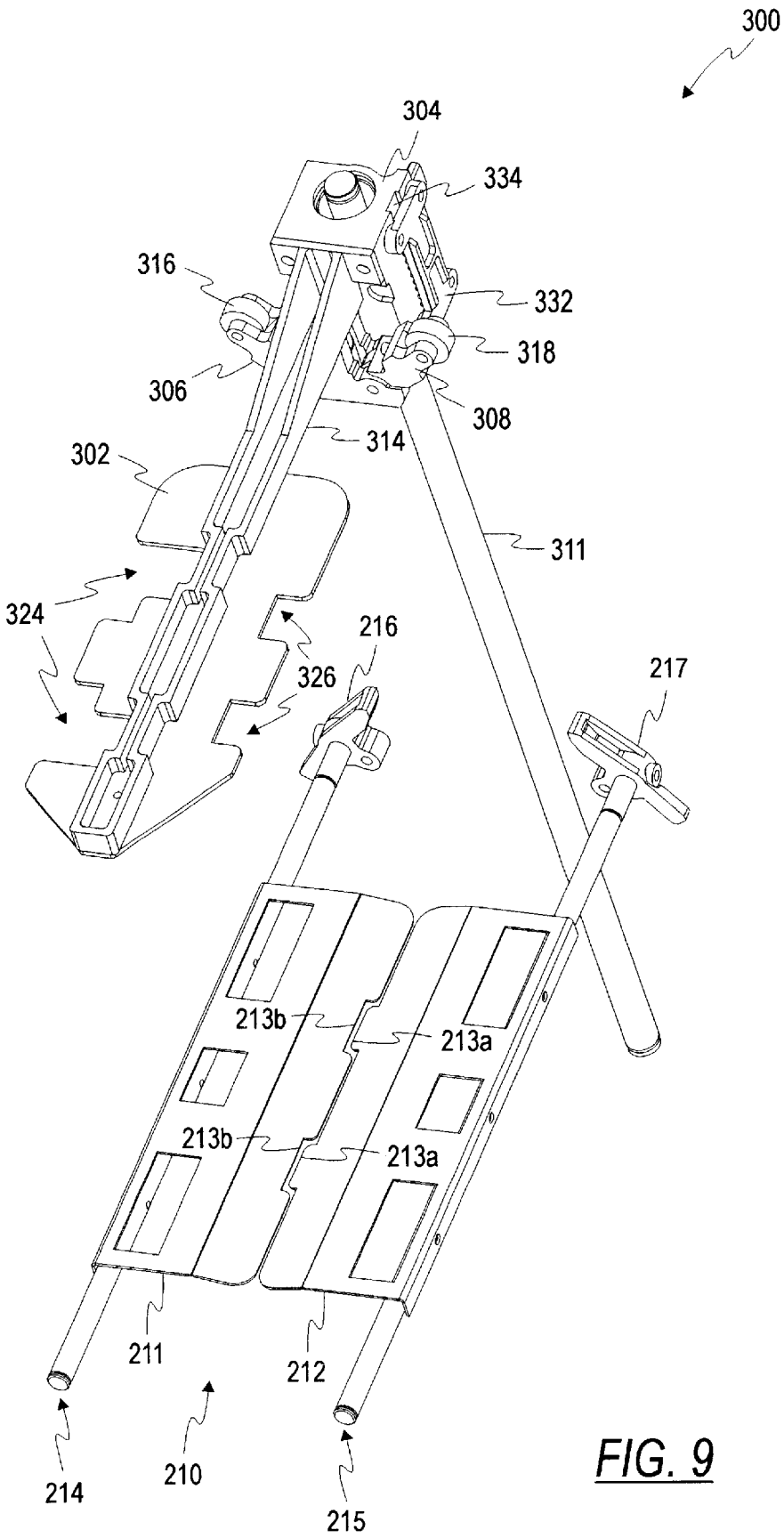
FIG. 9 is a perspective view of an apparatus for transferring currency from an escrow compartment to a storage cassette according to one embodiment of the document handling device of the present invention.

Referring now to FIG. 9, the plunger assembly 300 for selectively transferring the bills 204 from an escrow compartment 116 to a corresponding storage cassette 118 and the gate 210 are illustrated in more detail. One such plunger assembly 300 is provided for each of the six lower output receptacles 106*c*–106*h* of the currency handling device 100. The plunger assembly 300 comprises a paddle 302, a base 304, and two side arms 306, 308. Each of the shutters 211, 212 comprising the gate 210 extend inwardly from corresponding parallel bars 214, 215. The bars 214, 215 are mounted for pivoting the shutters between the closed position and the open position. Levers 216, 217 are coupled to the parallel bars 214, 215, respectively, to control the rotation of the bars 214, 215 and hence of the shutters 211, 212. Extension springs 218, 219 (shown in FIG. 8) tend to maintain the position of the levers 216, 217 both in the closed and open positions. The shutters 211, 212 have an integral tongue 213*a* and groove 213*b* arrangement which prevents any bills which are stacked upon the gate 210 from slipping between the shutters 211, 212.

The base 304 travels along a vertical shaft 311 with which it is slidably engaged. The base 304 may include linear bearings (not shown) to facilitate its movement along the vertical shaft 311. The plunger assembly 300 may also include a vertical guiding member 312 (see FIG. 11) with which the base 304 is also slidably engaged. The vertical guiding member 312 maintains the alignment of the plunger assembly 300 by preventing the plunger assembly 300 from twisting laterally about the vertical shaft 311 when the paddle 302 forces the bills 204 stacked in the escrow area 116 down into a storage cassette 118.

Figure 10:
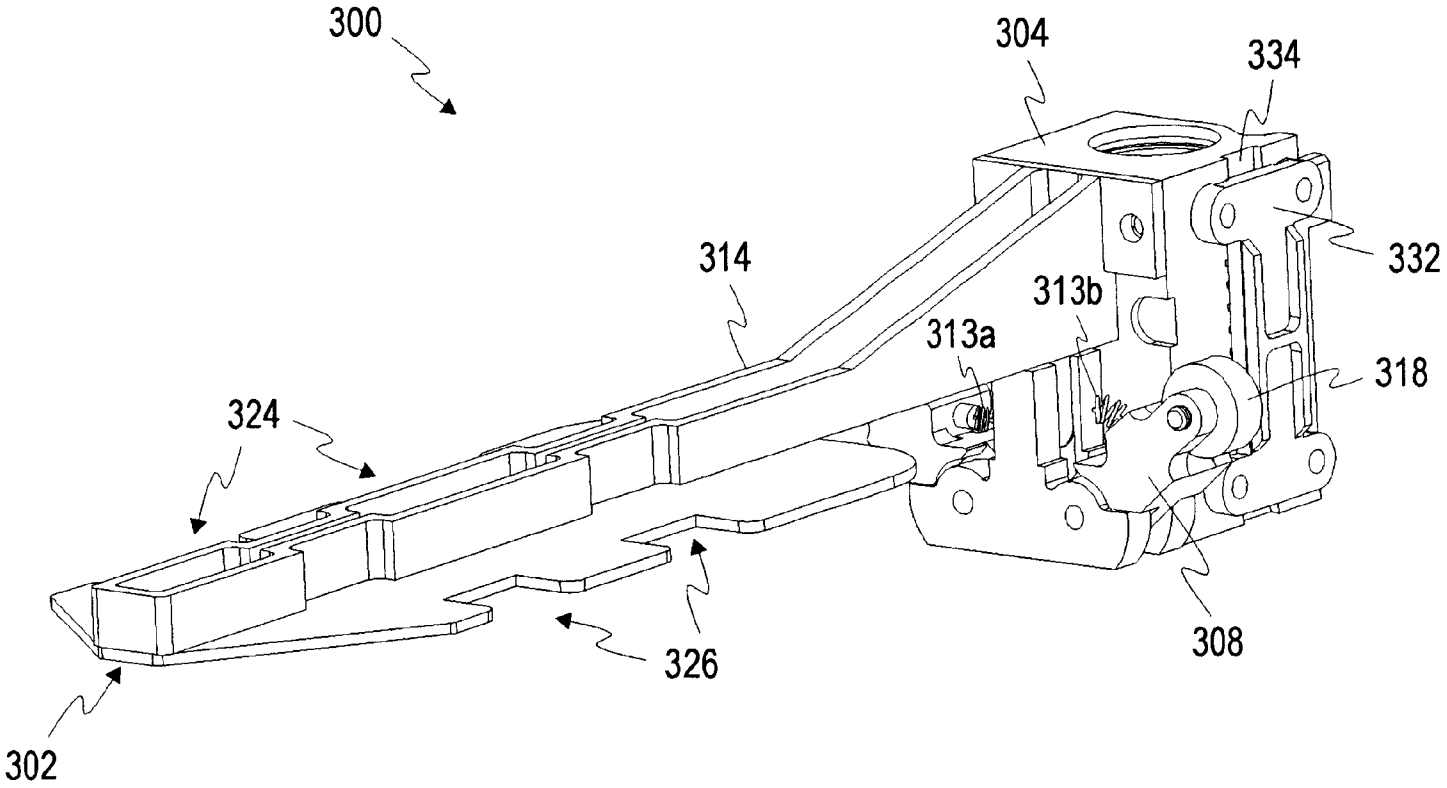
FIG. 10 is a perspective view of a paddle according to one embodiment of the document handling device of the present invention.

Referring also to FIG. 10, the paddle 302 extends laterally from the base 304. The paddle 302 is secured to a support 314 extending from the base 304. A pair of side arms 306, 308 are hingedly connected to the base. Each of the side arms 306, 308 protrude from the sides of the base 304. Rollers 316, 318 are attached to the side arms 306, 308, respectively, and are free rolling. Springs 313*a*, 313*b* are attached to the side arms 306, 308, respectively, to bias the side arms 306, 308 outward from the base 304. In the illustrated embodiment, the spring 313*a*, 313*b* are compression springs.

The paddle 302 contains a first pair of slots 324 to allow the paddle to clear the stacker wheel 202 when descending into and ascending out of the cassette 118. The first pair of slots 324 also enables the paddle 302 to clear the first pair of retaining tabs 350 within the storage cassette (see FIG. 14). Similarly, paddle 302 contains a second pair of slots 326 to enable the paddle 302 to clear the second pair of retaining tabs 350 within the storage cassette 118 (see FIG. 14).

Figure 11:
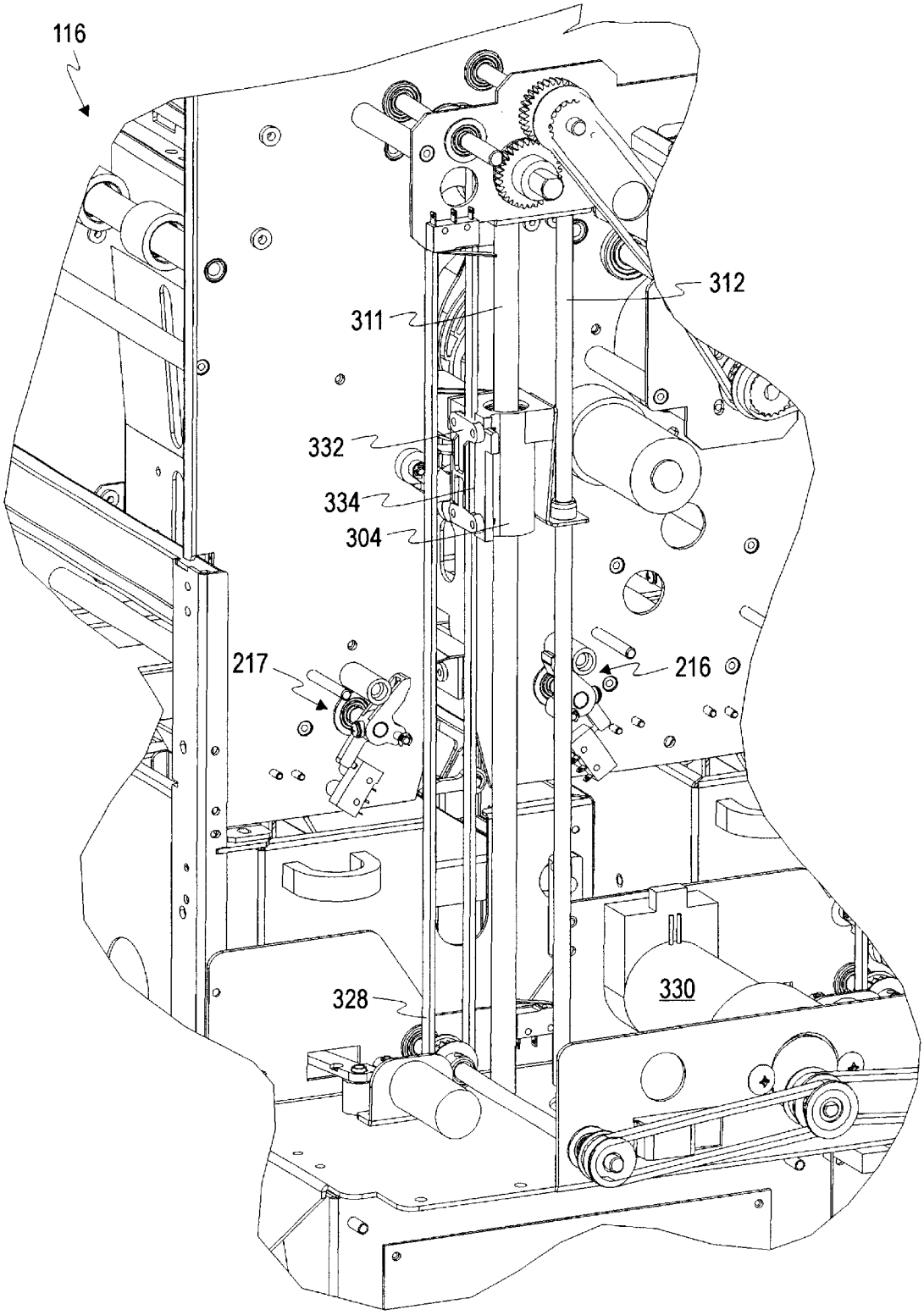
FIG. 11 is a rear perspective view of the escrow compartment, plunger assembly, and storage cassette according to one embodiment of the document handling device of the present invention.

Referring now to FIG. 11, which illustrates a rear view of one of the lower output receptacles 106*c*–106*h*, the plunger 300 is bidirectionally driven by way of a belt 328 coupled to an electric motor 330. A clamp 332 engages the belt 328 into a channel 334 in the base 304 of the plunger assembly 300. In the embodiment illustrated in FIG. 11, two plunger assemblies 300 are driven by a single electric motor 330. In one embodiment of the currency handling device, the belt 328 is a timing belt. In other alternative embodiments, each plunger assembly 300 can be driven by a single electric motor 330. In still other alternative embodiments, there can be any combination of motors 330 to plunger assemblies 300.

Figure 12:
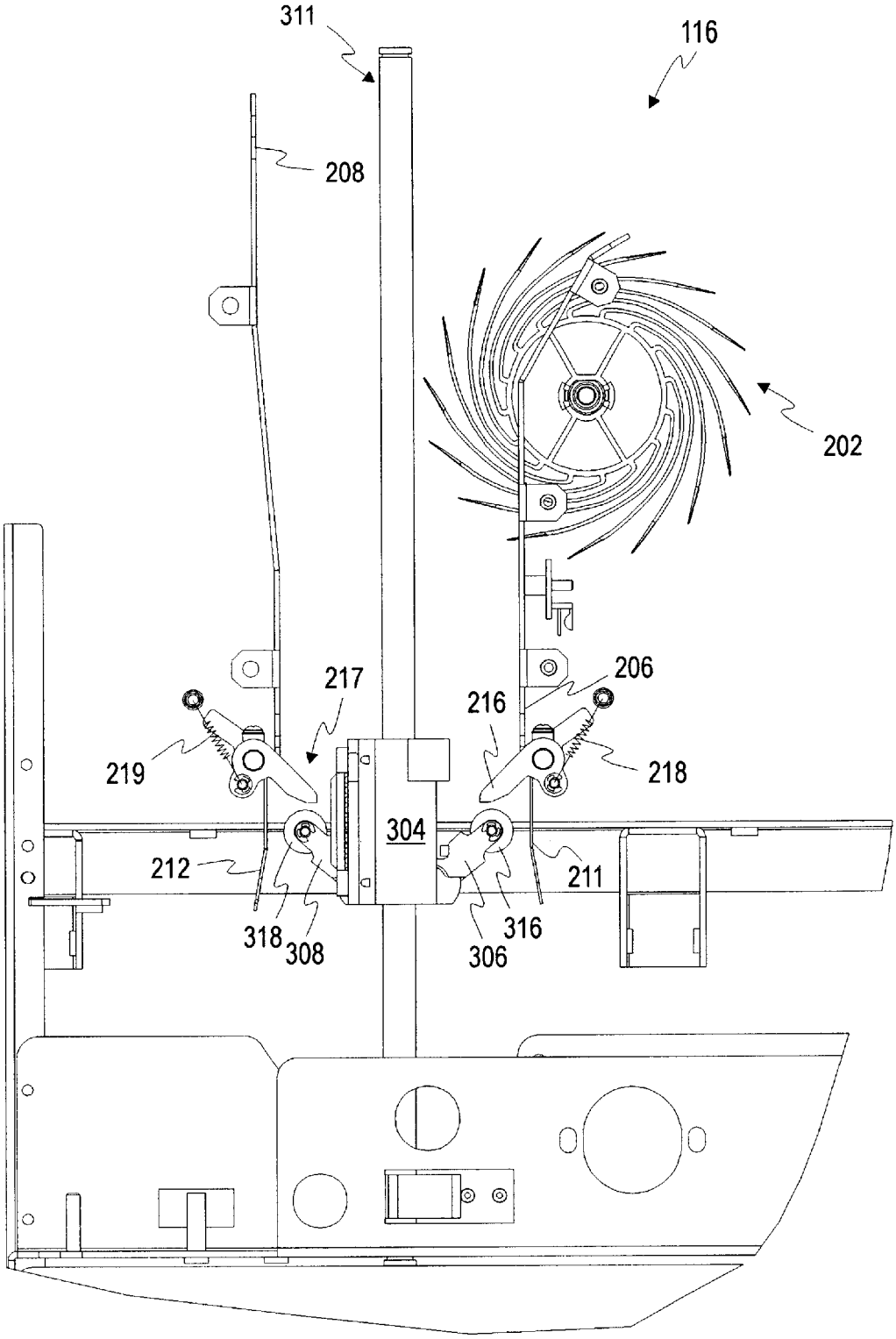
FIG. 12 is a rear view of a plunger assembly wherein the gate is in the open position according to one embodiment of the document handling device of the present invention.
Figure 13:
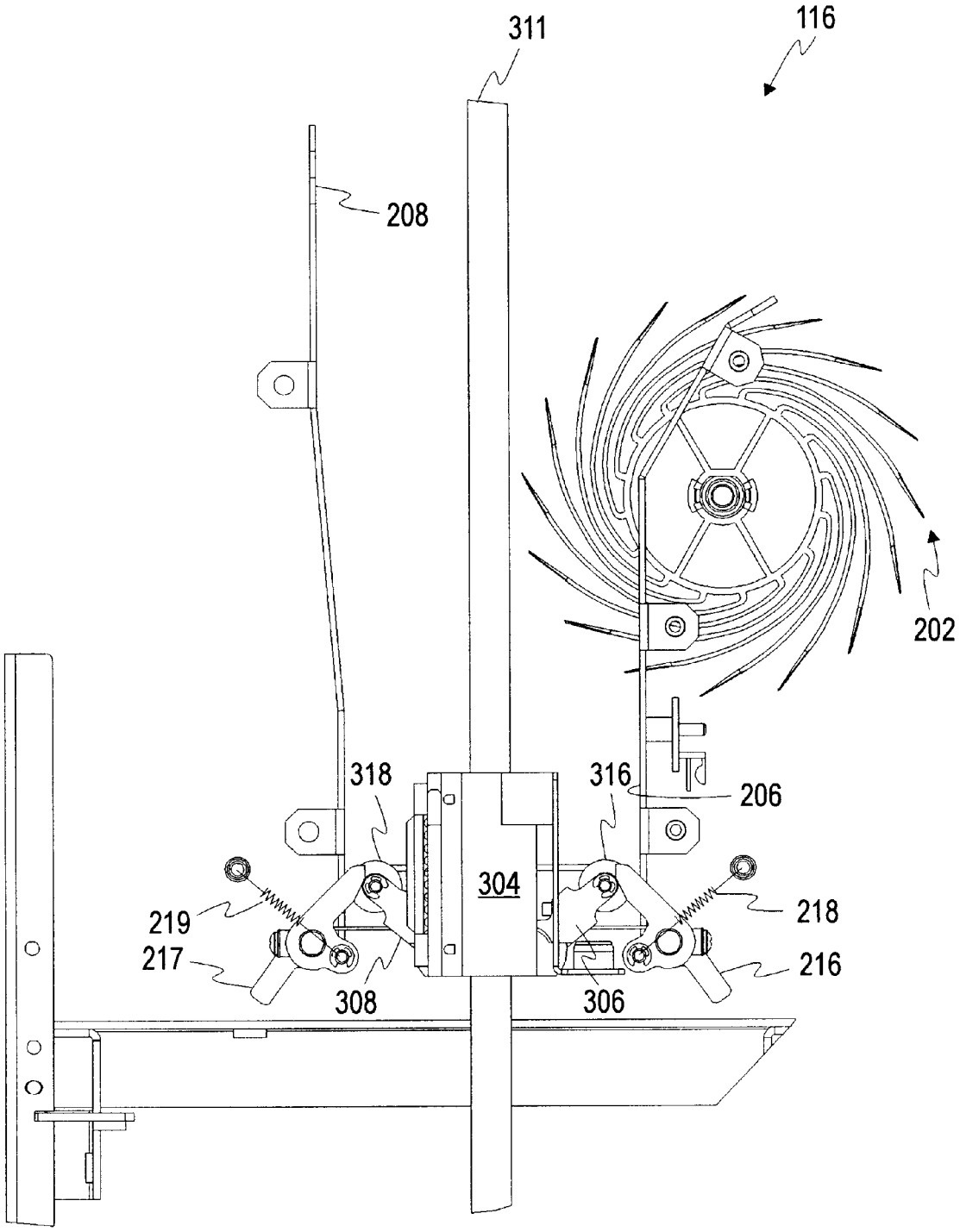
FIG. 13 is a rear view of a plunger assembly wherein the gate is in the closed position according to one embodiment of the document handling device of the present invention.

FIGS. 12 and 13 illustrate the interaction between the side arms 306, 308 and the levers 216, 217 when the paddle assembly 300 is descending towards and ascending away from the storage cassette 118, respectively. Initially, before descending towards the cassette, the shutters are in a first (closed) position. In the illustrated embodiment, it is the force imparted by the paddle 302 which opens the gate 210 when the paddle descends towards the storage cassette 118. When the paddle is ascending away from the storage cassette 119, it is the rollers 316, 318 coupled to the side arms 306, 308 which engage the levers 216, 217 that close the gate 210. The levers 216, 217 shown in FIG. 12 are positioned in the open position. When descending towards the storage cassette 118, the rollers 316, 318 contact the levers 216, 217 and roll around the levers 216, 217 leaving the shutters in the open position. The side arms 306, 308 are hinged in a manner which allows the side arms 306, 308 to rotate inward towards the base 304 as the rollers 316, 318 engage the levers 216, 217. FIG. 13 illustrates the levers in the second position wherein the gate 210 is closed. When the paddle ascends out of the storage cassette, the side arms 306, 308 are biased away from the base 304. The rollers 316, 318 engage the levers 216, 217 causing the levers to rotate upward to the first position thus closing the gate.

Figure 14:
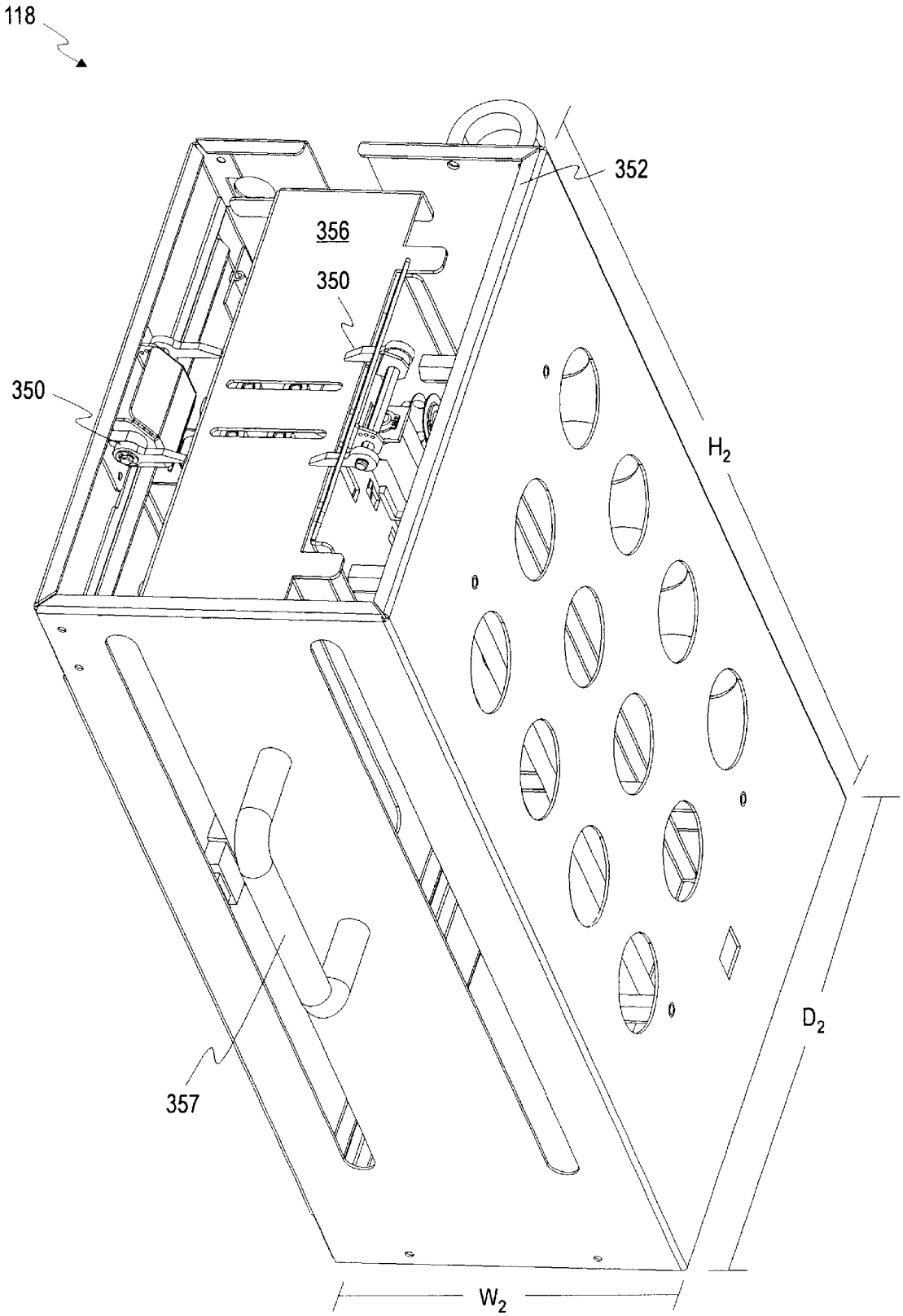
FIG. 14 is a perspective view of a storage cassette according to one embodiment of the document handling device of the present invention.
Figure 15:
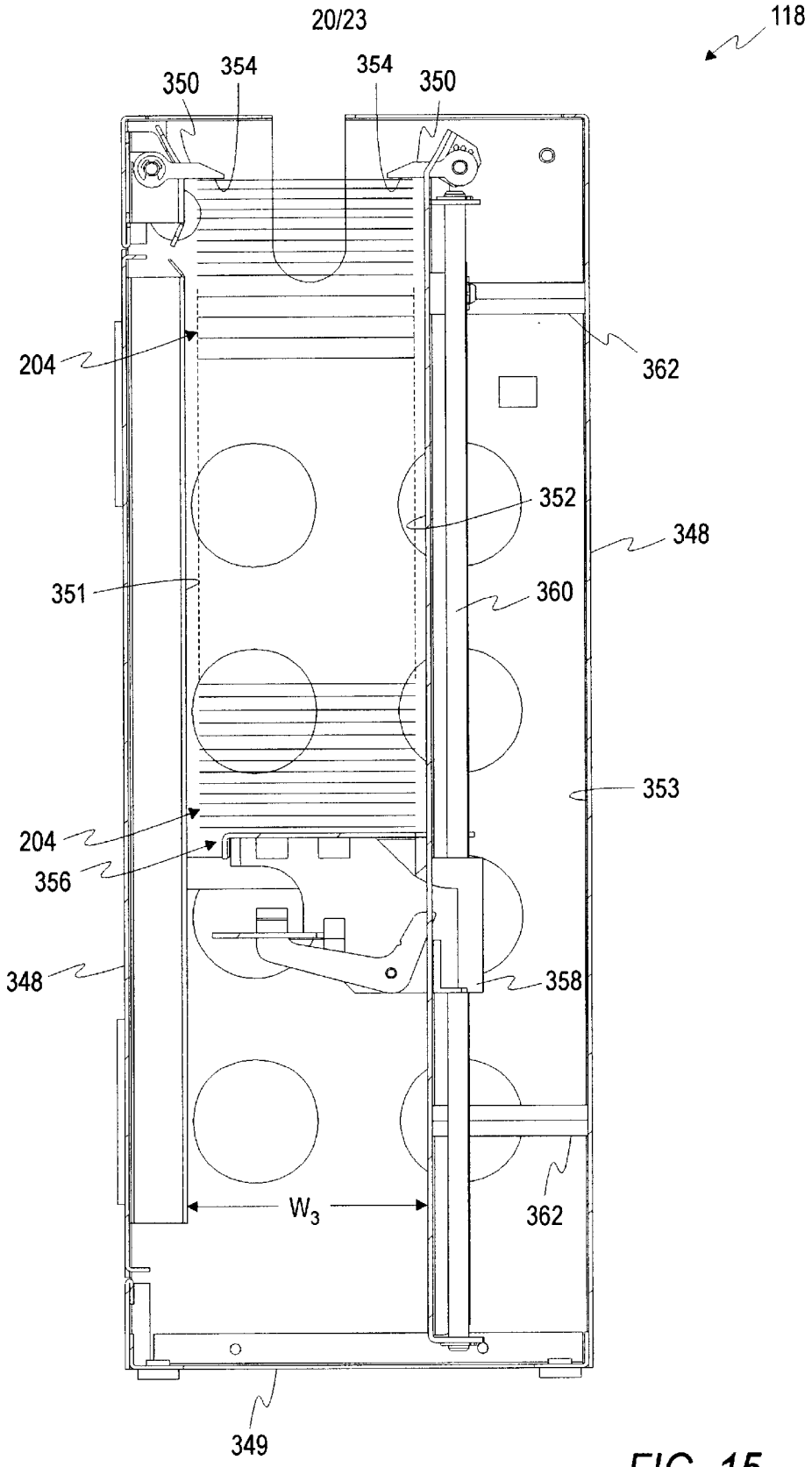
FIG. 15 is a rear view of a storage cassette according to one embodiment of the document handling device of the present invention.
Figure 16:
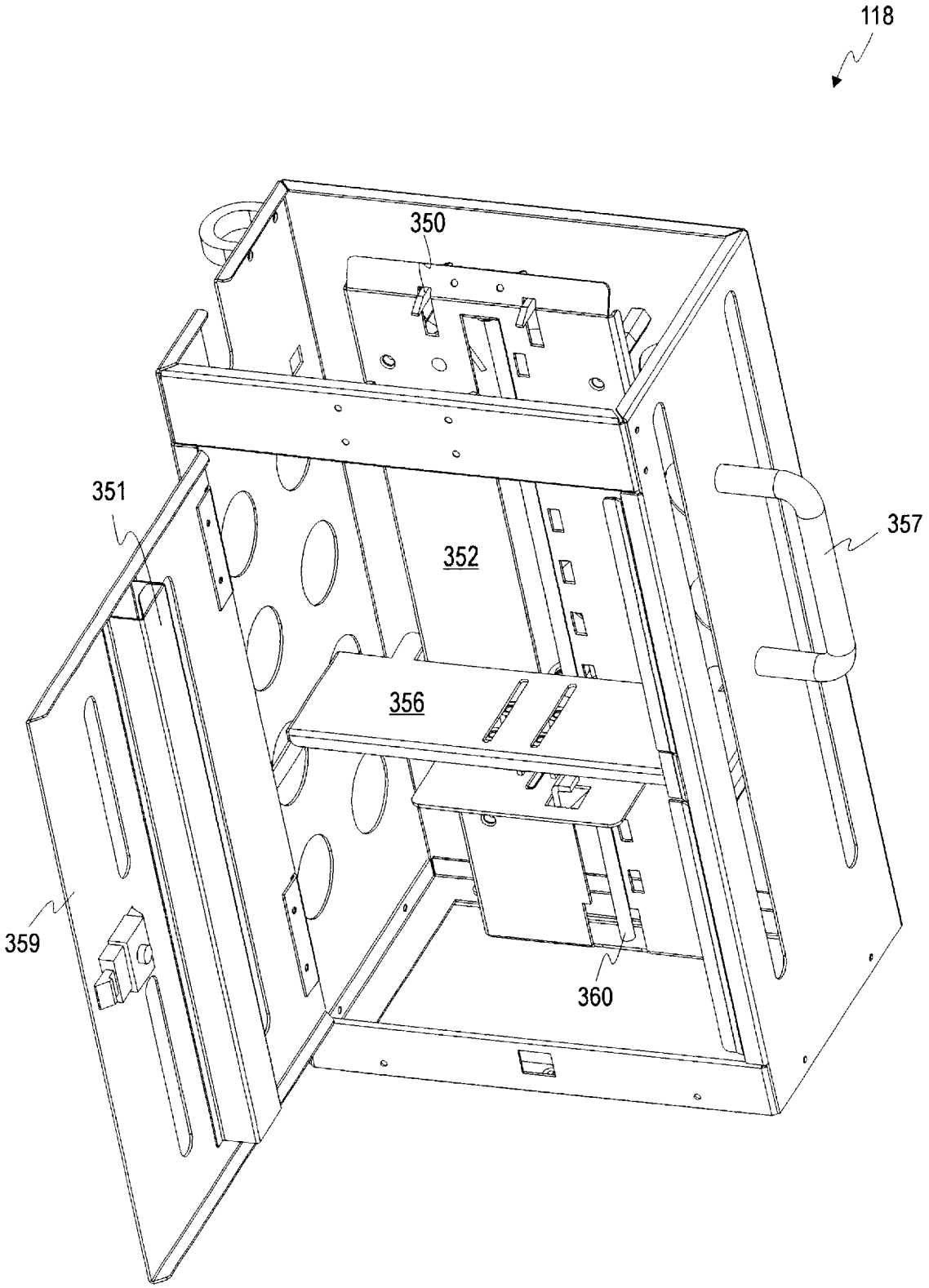
FIG. 16 is a perspective view of a storage cassette where the door is open according to one embodiment of the document handling device of the present invention.

FIGS. 14, 15, and 16 illustrate the components of the storage cassettes 118. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. The storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118.

Figure 17A:
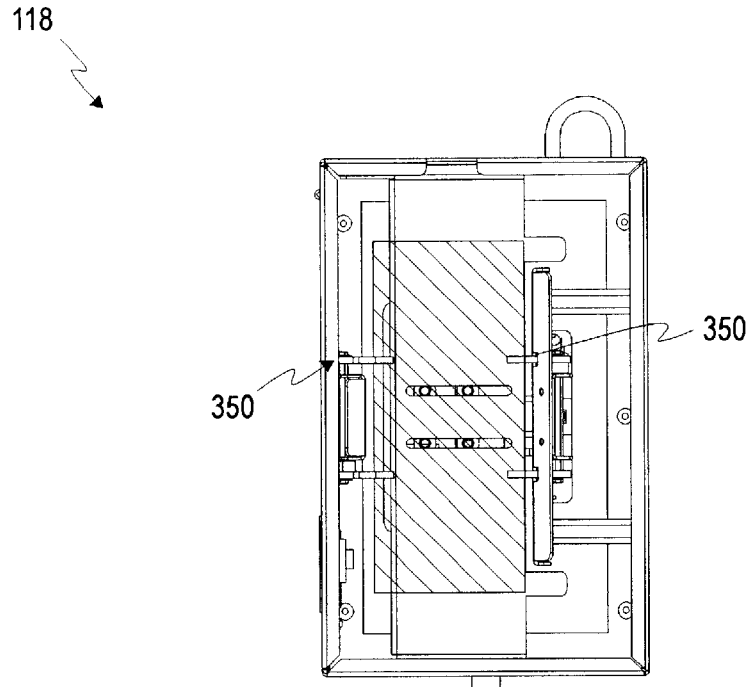
FIG. 17*a* is a top view of a storage cassette sized to accommodate United States currency documents according to one embodiment of the document handling device of the present invention.
Figure 17B:
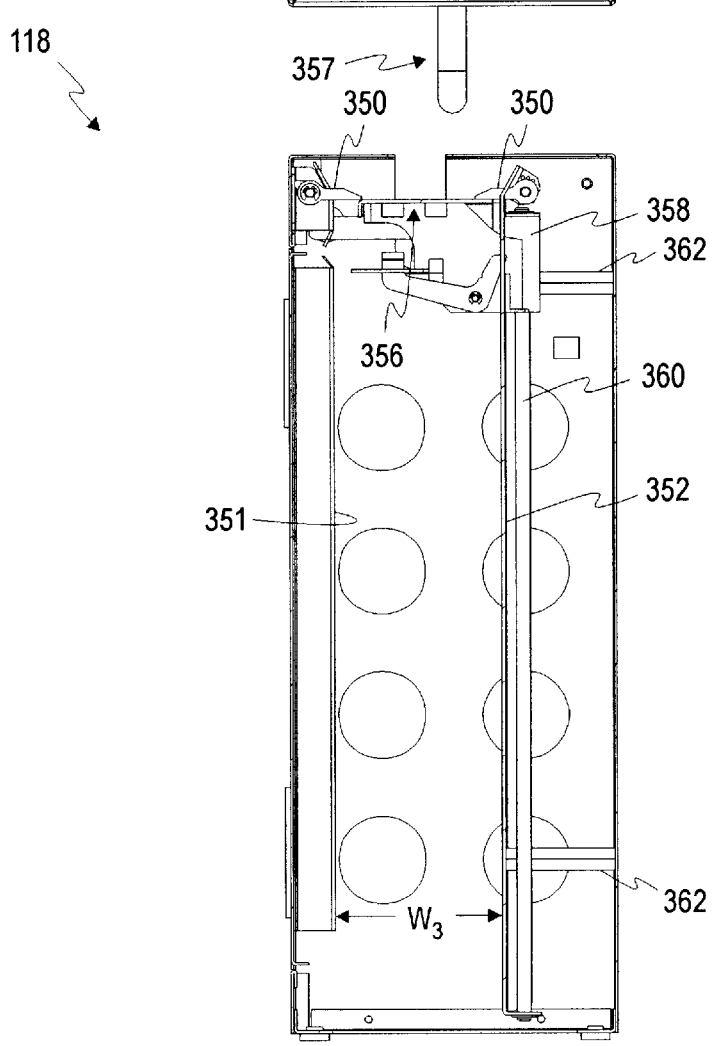
Figure 18A:
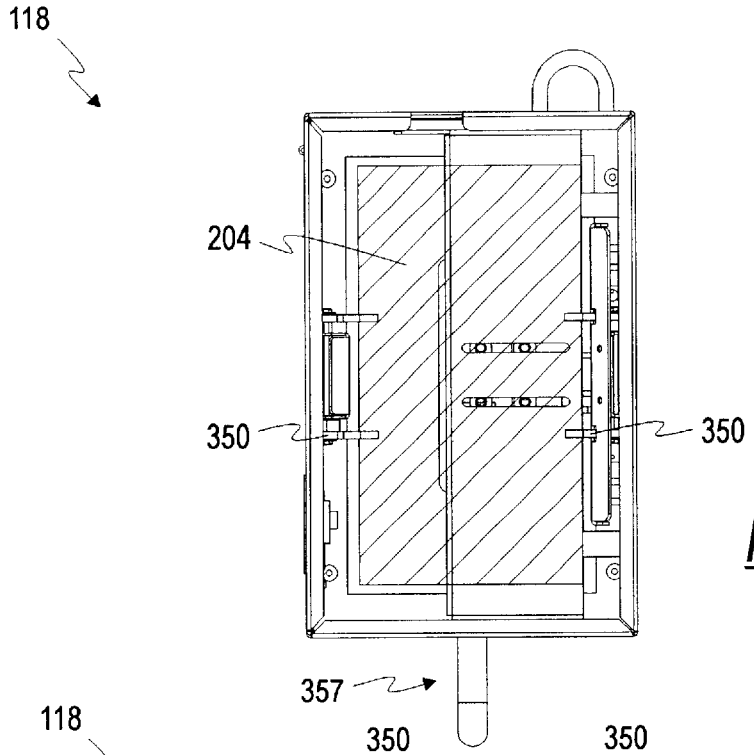
FIG. 18*a* is a top view of a storage cassette sized to accommodate large documents according to one embodiment of the document handling device of the present invention.
Figure 18B:
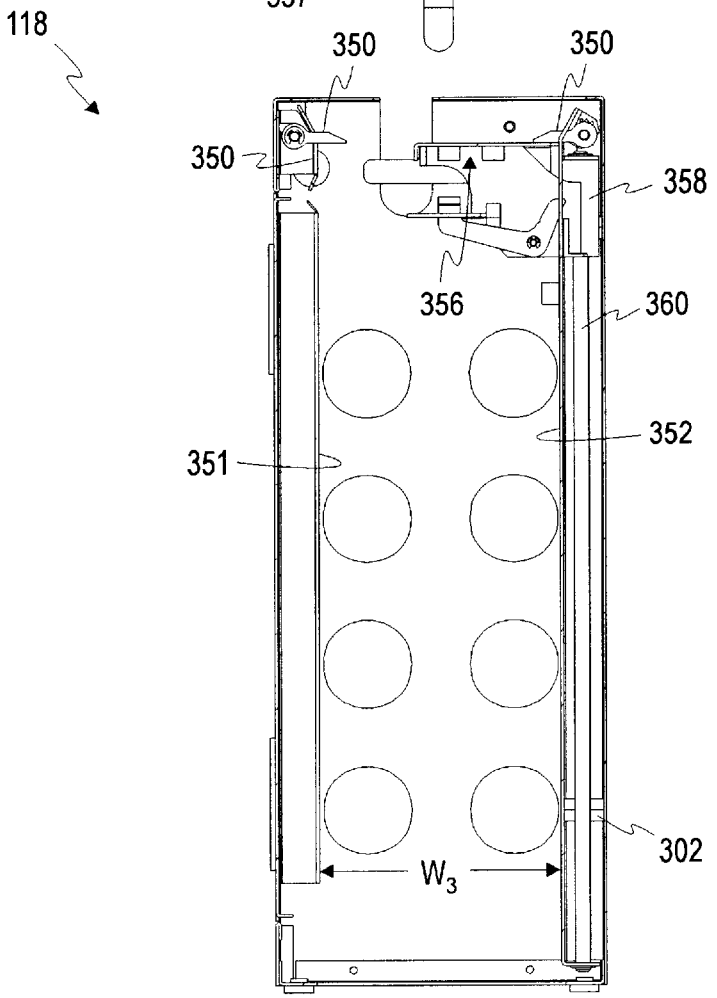
FIG. 18*b* is a rear view of a storage cassette sized to accommodate large documents according to one embodiment of the document handling device of the present invention.

The storage cassettes 118 are dimensioned to accommodate documents of varying sizes. In the illustrated embodiment, the storage cassettes 118 has a height, $H_2$, of approximately 15.38 inches (39 cm), a depth, $D_2$, of approximately 9 inches (22.9 cm), and a width, $W_2$, of approximately 5.66 inches (14.4 cm). The storage cassette illustrated in FIG. 15 has stand-offs 362 to set interior wall 352 off a fixed distance from in the interior wall 353 of the cassette housing 348. The interior walls 351, 352 aid in aligning the bills in a stack within the storage cassettes. The embodiment of the storage cassette illustrate in FIG. 15 is sized to accommodate United States currency documents. To properly accommodate United States currency documents, the interior width of the storage cassette, $W_3$, is approximately 2.88 inches. FIGS. 17*a* and 17*b* also illustrate an embodiment of the storage cassette 118 sized to accommodate U.S. currency documents which have a width of approximately 2.5 inches (approximately 6.5 cm) and a length of approximately 6 inches (approximately 15.5 cm). In alternative embodiments, the length of the stand-offs 362 can be varied to accommodate documents of varying sizes. For example, the embodiment disclosed in FIGS. 18*a* and 18*b* has an interior width, $W_3$ of approximately 4.12 inches (104.6 cm) and is sized to accommodate the largest international currency, the French 500 Franc note, which has width of approximately 3.82 inches (9.7 cm) and a length of approximately 7.17 inches (18.2 cm). In order to accommodate large documents and increase the interior width, $W_3$, of the storage cassette 118, the lengths of stand-offs 362, illustrated in FIG. 16*b*, are shortened.

Beginning with FIG. 7, the operation of one of the lower output receptacles 106*c*–106*h* will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. Pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIGS. 8 and 9 the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

Referring now to FIG. 15, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 (FIG. 9) to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

Referring now to FIG. 13, when the plunger assembly 300 is traveling upward out of the cassette 118, the rollers 316, 318 on the side arms 306, 308 engage the respective levers 216, 217 and move the respective levers 216, 217 from the second (open) position to the first (closed) position to move the gate 210 from the open position to the closed position as the paddle 302 ascends into the escrow compartment 116 after depositing the bills 204 in the storage cassette 118. The paddle 302 is mounted on the base 304 above the rollers 316, 318 on the side arms 306, 308 so that the paddle 302 clears the gate 210 before the gate 210 is moved to the closed position.

In alternative embodiments of the currency handling device 100, the output receptacles 106 can be sized to accommodate documents of varying sizes such as various international currencies, stock certificates, postage stamps, store coupons, etc. Specifically, to accommodate documents of different widths, the width of the escrow compartment 116, the gate 210, and the storage cassette 118 would need to be increased or decreased as appropriate. The document evaluation device 100 is sized to accommodate storage cassettes 118 and gates 210 of different widths. The entire transport mechanism 104 of the currency handling device 100 is dimensioned to accommodate the largest currency bills internationally. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may simply require the segregation of the U.S. currency from the French currency wherein the currency handling device 100 delivers U.S. currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c* and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, French currency is delivered to the fifth lower output receptacle 106*g*, and German currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*–106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggravate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*–106*h*. The currency handling device 100 which has eight output receptacles 106*a*–106*h* provides a great deal of flexibility to the user. And in other alternative embodiments of the currency handling device 100, numerous different combinations for processing documents are available.

According to one embodiment, the various operations of the currency handling device 100 are controlled by processors disposed on a number of printed circuit boards ("PCBs") such as ten PCBs located throughout the device 100. In one embodiment of the present invention, the processors are Motorola processors, model number 86HC 16, manufactured by Motorola, Inc. of Schaumburg, Ill. Each of the processors are linked to a central controller via a general purpose communications controller disposed on each PCB. In one embodiment of the present invention the communications controller is an ARCNET communications controller, model COM20020, manufactured by Standard Microsystems Corporation of Hauppauge, N.Y. The communications controller enables the central controller to quickly and efficiently communicate with the various components linked to the PCBs.

According to one embodiment, two PCBs, a "motor board" and a "sensor board," are associated with each pair of lower output receptacles 106*c*–106*h*. The first two lower output receptacles 106*c,d*, the second two lower output receptacles 106*e,f*, and the last two lower output receptacles 106*g,h* are paired together. Each of the lower output receptacles 106 contain sensors which track the movement of the bills into the lower output receptacles 106*c*–106*h*, detect whether each storage cassette 118*a*–118*e* is positioned within the currency handling device 100, detect whether the doors 359 of the storage cassettes 118 are opened or closed, and whether the cassettes 118 are full. These aforementioned sensors associated with each pair of the lower output receptacles are tied into a sensor board which is linked to the central controller. The operation of the plunger assembly 300, the stacker wheels 202, the portion of transportation mechanism 104 disposed above the lower output receptacles 116*c*–116*h*, and the diverters 130 are controlled by processors disposed on the motor board associated with each pair of lower output receptacle's 106*c*–106*h*. Those sensors 130 which track the movement of bills along the transportation mechanism 104 that are disposed directly above the lower output receptacles 106*c*–106*h* are also tied into the respective motor boards.

One of the four remaining PCBs is associated with the operation of the one or two stacker wheels 127 associated with the upper output receptacles 106*a,b*, the stripping wheels 140, the primary drive motor of the evaluation region 108, a diverter which direct bills to the two upper output receptacles 106*a,b*, and the diverter which then directs bills between the two upper output receptacles 106*a,b*. The remaining three PCBs are associated with the operation of the transport mechanism 104 and a diverter which directs bills from the transport path to the bill facing mechanism 110. The plurality of sensors 130 disposed along the transport mechanism 104, used to track the movement of bills along the transport mechanism 104, also tied into these three remaining PCBs.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. An apparatus for transferring a plurality of documents from a first compartment to a second compartment, the apparatus comprising:

a plunger assembly, the plunger assembly including a paddle being adapted to contact the documents;

at least one outwardly extending arm hingedly connected to the plunger assembly;

a gate disposed between the first compartment and the second compartment, the gate having an open position and a closed position, the gate being adapted to form a document supporting surface when in the closed position;

at least one lever extending from the gate, the lever being in a first position when the gate is in the closed position and the lever being in a second position when the gate is in the open position; and wherein the gate is adapted to move from the closed position to the open position when the paddle urges the documents against the gate from the first compartment towards the second compartment, and wherein the arm is adapted to move the lever from the second position to the first position to move the gate from the open position to the closed position when the paddle retracts from the second compartment to the first compartment.

2. The apparatus of claim 1 wherein the gate comprises:

a rotatable shaft extending transversely across an opening of the second compartment; and a shutter connected to the shaft.

3. The apparatus of claim 1 wherein the gate comprises:

first and second parallel rotatable shafts extending transversely across an opening of the second compartment;

a first shutter connected to the first shaft; and a second shutter connected to the second shaft.

4. The apparatus of claim 3 wherein the at least one lever comprises a first lever extending from the first shaft and a second lever extending from the second shaft, the first and second levers being in the first position when the gate is closed and in the second position when the gate is open, and wherein the at least one arm includes first and second arms extending from the plunger assembly to move the first and second levers from the second position to the first position to close the first and second shutters when the paddle retracts from the second compartment to the first compartment.

5. The apparatus of claim 1 further comprising a belt adapted to bidirectionally drive the plunger assembly.

6. The apparatus of claim 5 wherein the belt is a timing belt.

7. The apparatus of claim 1 further comprising a spring coupled to the lever, the spring being adapted to maintain the gate in the open and the closed position.

8. The apparatus of claim 1 wherein the plunger assembly further comprises a resilient member adapted to urge the arm away from the plunger assembly.

9. The apparatus of claim 8 wherein the resilient member is a spring.

10. The apparatus of claim 1 further comprising one or more guides adapted to align the items within the first compartment.

11. The apparatus of claim 1 further comprising a rigid support member, wherein the plunger assembly is slidably engaged to the rigid support member.

12. The apparatus of claim 11 further comprising a rigid guide member, wherein the plunger assembly is slidably engaged to the rigid guide member.

13. The apparatus of claim 1 further comprising a stacker wheel being adapted to stack documents upon the gate.

14. The apparatus of claim 1 wherein the first compartment, the gate, and the second compartment are each adapted to accommodate bills ranging in size from about 4.39 inches long by about 2.40 inches wide to about 7.17 inches long by about 3.82 inches wide.

15. An apparatus for transferring a plurality of documents from a first compartment to a second compartment comprising:

a bidirectionally moveable base having a front, a first side, and a second side;

a paddle extending laterally from the front of the base;

a first arm hingedly protruding from the first side of the base;

a second arm hingedly protruding from the second side of the base;

a gate disposed between the first compartment and the second compartment forming a document supporting surface, the gate comprising a first shutter and a second shutter, wherein the first shutter and the second shutter are generally parallel when the gate is in an open position, and wherein the first shutter and the second shutter are generally coplanar when the gate is in a closed position;

a first lever operatively associated with the first shutter, the first lever being in a first position when the gate is in the closed position and the first lever being in a second position when the gate is in the open position;

a second lever operatively associated with the second shutter, the second lever being in a first position when the gate is in the closed position and the second lever being in a second position when the gate is in the open position; and wherein the gate moves from the closed position to the open position when the paddle urges the documents in the first compartment against the gate towards the second compartment, and wherein the first and second arms move the first and second levers from the second position to the first position to move the gate from the open position to the closed position when the paddle retracts from the second compartment to the first compartment.

16. The apparatus of claim 15 wherein the first and second shutters respectively comprise a first and a second parallel rotatable shafts extending transversely across an opening of the second compartment.

17. The apparatus of claim 15 further comprising a belt adapted to bidirectionally drive the base.

18. The apparatus of claim 15 wherein the belt is a timing belt.

19. The apparatus of claim 15 further comprising:

a first resilient member attached to the first lever adapted to maintain the first lever in the second position; and a second resilient member attached to the second lever adapted to maintain the second lever in the second position.

20. The apparatus of claim 19 wherein the first resilient member is a spring and the second resilient member is a spring.

21. The apparatus of claim 15 further comprising:

a first resilient member coupled to the first arm, the first resilient member adapted to urge the first arm away from the base; and a second resilient member coupled to the second arm, the second resilient member adapted to urge the second arm away from the base.

22. The apparatus of claim 21 wherein the first resilient member is a spring and the second resilient member is a spring.

23. The apparatus of claim 15 further comprising one or more guides adapted to align the documents within the first compartment.

24. The apparatus of claim 15 wherein the first compartment, the gate, and the second compartment are each adapted to accommodate documents ranging in size from about 4.39 inches long by about 2.40 inches wide to about 7.17 inches long by about 3.82 inches wide.

25. A currency evaluation device for receiving a plurality of currency bills and rapidly evaluating each of the bills, the device comprising:

an input receptacle being adapted to receive a plurality of bills to be evaluated;

a plurality of output receptacles adapted to receive the bills after the bills have been evaluated, at least one of the output receptacles having a first compartment and a second compartment, the output receptacle having a gate disposed between the first compartment and the second compartment, the gate having an open position and a closed position, the gate being adapted to form a bill supporting surface when in the closed position, the gate having at least one lever outwardly extending therefrom, the lever being in a first position when the gate is in the closed position and the lever being in a second position when the gate is in the open position;

a transport mechanism being adapted to transport the bills, one at a time along a transport path, from the input receptacle to the first compartment of one of the output receptacles;

a paddle being adapted to urge the bills from the first compartment towards the second compartment wherein the paddle presses against the bills and causes the gate to move from the closed position to the open position, and wherein the paddle is adapted to engage the lever to move the gate from the open position to the closed position when the paddle retracts from the second compartment to the first compartment;

an evaluating unit being adapted to determine information concerning the bills, the evaluation unit having at least one sensor positioned along the transport path between the input receptacle and the output receptacles;

an operator interface being adapted to receive operational instructions from a user and to display the information concerning the bills; and a controller being adapted to couple the operator interface and the evaluation unit, the controller causing the discriminating unit to operate in one of a plurality of operating modes which determine into which output receptacle each bill is delivered in response to the operational instructions from the user.

26. The currency handling device of claim 25 wherein the input receptacle further comprises:

a front end and a back end;

a feeder mechanism disposed in the front end of the receptacle, the feeder mechanism being adapted to transfer the bills, one at a time, from the input receptacle; and a first paddle and a second paddle, the first paddle being adapted to urge a first stack of bills towards the feeder mechanism, the second paddle being adapted to urge a second stack of bills towards the feeder mechanism.

27. The currency handling device of claim 26 further comprising a first and a second spring coupled to the first and the second paddles, respectively, the first and second springs being adapted to bias the first and second paddles, respectively, towards the feeder mechanism.

28. The currency handling device of claim 26 wherein the feeder mechanism comprises at least one stripping wheel.

29. The currency handling device of claim 25 wherein the input receptacle, the output receptacles, and the transport mechanism are each adapted to accommodate bills ranging in size from about 4.39 inches long by about 2.40 inches wide to about 7.17 inches long by about 3.82 inches wide.

30. The currency handling device of claim 25 wherein the gate comprises:

a rotatable shaft extending transversely across an opening of the second compartment; and a shutter connected to the shaft.

31. The currency handling device of claim 25 further comprising a resilient member coupled to the at least one lever, the resilient member being adapted to maintain the gate in the open and the closed position.

32. The currency handling device of claim 25 wherein the resilient member is a spring.

33. The currency handling device of claim 25 wherein the gate comprises:

a first and a second parallel rotatable shafts extending transversely across an opening of the second compartment;

a first shutter connected to the first shaft; and a second shutter connected to the second shaft.

34. The currency handling device of claim 33 wherein the at least one lever comprises a first lever extending from the first shaft and a second lever extending from the second shaft, the first and second levers being in the first position when the gate is closed and in the second position when the gate is open; and wherein the paddle is adapted to move the first and second levers from the second position to the first position to close the first and the second shutter when the paddle retracts from the second compartment to the first compartment.

35. The currency handling device of claim 25 further comprising:

a first resilient member coupled to the first lever, the first resilient member adapted to maintain the first lever in the first and the second positions; and a second resilient member coupled to the second lever, the second resilient member adapted to maintain the second lever in the first and the second positions.

36. The currency handling device of claim 35 wherein the first resilient member comprises a spring and the second resilient member comprises a spring.

37. The currency handling device of claim 25 further comprising a belt being adapted to bidirectionally drive the base.

38. The currency handling device of claim 37 wherein the belt is a timing belt.

39. The currency handling device of claim 25 further comprising one or more guides being adapted to align the bills within the first compartment.

40. The currency handling device of claim 25 wherein the first compartment further comprises a stacker wheel being adapted to stack the bills upon the gate.

41. The currency handling device of claim 25 wherein each of the output receptacles further comprises a stacker wheel being adapted to stack the bills within the output receptacles.

42. The currency handling device of claim 25 further comprising a bill facing mechanism disposed along the transport path between the evaluation region and the plurality of output receptacles, the bill facing mechanism being adapted to rotate a bill approximately 180°.

43. A currency handling system for evaluating and sorting currency bills, the system comprising:

an input receptacle being adapted to receive a stack of bills, the input receptacle having a feeder mechanism adapted to feed the bills, one at a time, from the input receptacle, the input receptacle having at least one paddle adapted to urge the stack of bills towards the feeder mechanism;

a transport mechanism being adapted to transport the bills along a transport path from the feeder mechanism of the input receptacle, one at a time, to a plurality of output receptacles, wherein the transport mechanism positively grips the currency bills for a substantial portion of the transport path;

an evaluation region disposed along the transport path between the input receptacle and the plurality of output receptacles, the evaluation region being adapted to denominate, authenticate, identify bill orientation, and identify bill size, the evaluation region being adapted to generate signals indicative of the bill's denomination, authenticity, orientation, and/or size;

a plurality of diverters disposed along the transport path adjacent to the plurality of output receptacles, the plurality of diverters adapted to direct currency bills into the plurality of output receptacles wherein at least one of the plurality of output receptacles comprises an escrow compartment positioned above a storage cassette, and wherein bills are initially stacked in the escrow compartment, the storage cassettes being adapted to receive a plurality of stacks of currency bills from the escrow compartment;

each of the plurality of escrow compartments comprising:

a stacker wheel being adapted to receive currency bills from the one of the plurality of diverters and to stack the bills with in the escrow compartment, a gate adapted to receive currency bills from the stacker wheel, wherein the stacker wheel is adapted to stack the bills on the gate, the gate having an open position and a closed position, at least one lever extending from the gate, the lever being in a first position when the gate is in the open position and the lever being in a second position when the gate is in the closed position; and a document transfer mechanism being adapted to transfer the bills from the escrow compartment into the storage cassette, each document transfer mechanism comprising:

a rigid support member extending from adjacent the escrow compartment to adjacent the cassette, a base slidably engaged to the rigid support member, a paddle extending from the base being adapted to contact the bills stacked with the escrow compartment on the gate, at least one outwardly extending arm hingedly connected to the base, wherein the paddle is adapted to urge the bills stacked within the escrow compartment against the gate of the escrow compartment to move the gate from a closed position to an open position as the paddle descends into the storage cassette, and wherein the at least one outwardly extending arm is adapted to move the lever from the first position to the second position to move the gate from the open position to the closed position as the paddle retracts from the storage cassette;

each of the storage cassettes comprising:

a base;

two sides rigidly attached to the base;

two tabs hingedly connected to each of the two sides, the tabs having a substantially flat bottom surface;

a spring coupled to each tab being adapted to maintain each tab in a horizontal position;

a platform being adapted to receive the currency bills, the platform adapted to urge the bills against the bottom side of the tabs.

44. The currency handling device of claim 43 wherein the input receptacle, the transport mechanism, and the output receptacles are each adapted to accommodate bills ranging in size from about 4.39 inches long by about 2.40 inches wide to about 7.17 inches long by about 3.82 inches wide.

45. The currency handling device of claim 43 further comprising a bill facing mechanism disposed along the transport path between the evaluation region and the plurality of output receptacles, the bill facing mechanism being adapted to rotate a bill approximately 180°.

46. The currency handling device of claim 43 wherein the feeder mechanism comprises at least one stripping wheel.

47. A currency evaluation device for receiving a plurality of currency bills and rapidly evaluating each of the bills, the device comprising:

an input receptacle being adapted to receive the plurality of bills to be evaluated, the input receptacle being adapted to accommodate bills ranging in size from about 4.39 inches long by about 2.40 inches wide to about 7.17 inches long by about 3.82 inches wide;

a plurality of output receptacles adapted to receive the bills after the bills have been evaluated, at least one of the output receptacles having a first compartment and a second compartment, the output receptacle having a gate disposed between the first compartment and the second compartment, the gate having an open position and a closed position, the gate being adapted to form a bill supporting surface when in the closed position, the gate having at least one lever outwardly extending therefrom, the lever being in a first position when the gate is in the closed position and the lever being in a second position when the gate is in the open position, each of the first and second compartments being adapted to accommodate bills ranging in size from about 4.39 inches long by about 2.40 inches wide to about 7.17 inches long by about 3.82 inches wide;

a transport mechanism being adapted to transport the bills, one at a time along a transport path, from the input receptacle to the first compartment of one of the output receptacles, the transport mechanism being adapted to accommodate bills ranging in size from about 4.39 inches long by about 2.40 inches wide to about 7.17 inches long by about 3.82 inches wide;

a paddle being adapted to urge the bills from the first compartment towards the second compartment wherein the paddle presses against the bills and causes the gate to move from the closed position to the open position, and wherein the paddle is adapted to engage the lever to move the gate from the open position to the closed position when the paddle retracts from the second compartment to the first compartment;

an evaluation unit being adapted to determine information concerning the bills, the evaluation unit having at least one sensor positioned along the transport path between the input receptacle and the output receptacles;

an operator interface being adapted to receive operational instructions from a user and to display the information concerning the bills; and a controller being adapted to couple the operator interface and the evaluation unit, the controller being adapted to cause the evaluation unit to operate in one of a plurality of operating modes which determine into which output receptacle each bill is delivered in response to the operational instructions from the user.

48. The currency handling device of claim 47 wherein the input receptacle further comprises:

a front end and a back end;

a feeder mechanism disposed in the front end of the receptacle, the feeder mechanism being adapted to transfer the bills, one at a time, from the input receptacle; and a first paddle and a second paddle, the first paddle being adapted to urge a first stack of bills towards the feeder mechanism, the second paddle being adapted to urge a second stack of bills towards the feeder mechanism.

49. The currency handling device of claim 48 further comprising a first and a second spring coupled to the first and the second paddles, respectively, the first and second springs being adapted to bias the first and second paddles, respectively, towards the feeder mechanism.

50. The currency handling device of claim 48 wherein the feeder mechanism comprises at least one stripping wheel.

51. The currency handling device of claim 47 wherein the gate comprises:

a rotatable shaft extending transversely across an opening of the second compartment; and a shutter connected to the shaft.

52. The currency handling device of claim 47 further comprising a resilient member coupled to the at least one lever, the resilient member being adapted to maintain the gate in the open and the closed position.

53. The currency handling device of claim 52 wherein the resilient member is a spring.

54. The currency handling device of claim 47 wherein the gate comprises:

a first and a second parallel rotatable shafts extending transversely across an opening of the second compartment;

a first shutter connected to the first shaft; and a second shutter connected to the second shaft.

55. The currency handling device of claim 54 wherein the at least one lever comprises a first lever extending from the first shaft and a second lever extending from the second shaft, the first and second levers being in the first position when the gate is closed and in the second position when the gate is open; and wherein the paddle is adapted to move the first and second levers from the second position to the first position to close the first and second shutters when the paddle retracts from the second compartment to the first compartment.

56. The currency handling device of claim 47 further comprising:

a first resilient member coupled to the first lever, the first resilient member adapted to maintain the first lever in the first and the second positions; and a second resilient member coupled to the second lever, the second resilient member adapted to maintain the second lever in the first and the second positions.

57. The currency handling device of claim 56 wherein the first resilient member comprises a spring and the second resilient member comprises a spring.

58. The currency handling device of claim 47 further comprising a belt being adapted to bidirectionally drive the base.

59. The currency handling device of claim 58 wherein the belt is a timing belt.

60. The currency handling device of claim 47 further comprising one or more guides adapted to align the bills within the first compartment.

61. The currency handling device of claim 47 wherein the at least one first compartment further comprises a stacker wheel being adapted to stack the bills upon the gate.

62. The currency handling device of claim 47 wherein each of the output receptacles further comprises a stacker wheel being adapted to stack the bills within the output receptacles.

63. The currency handling device of claim 47 further comprising a bill facing mechanism disposed along the transport path between the evaluation region and the plurality of output receptacles, the bill facing mechanism being adapted to rotate a bill approximately 180°.

64. A currency evaluation device for monitoring the transportation of bills being evaluated by the device, the device comprising:

an input receptacle being adapted to receive a stack of bills to be evaluated;

a plurality of output receptacles being adapted to receive the bills after the bills have been evaluated;

a transport mechanism being adapted to transport the bills along a transport path, one at a time, from the input receptacle to the output receptacles;

an evaluation region being adapted to determine information concerning the bills, the evaluation region including at least one bill information sensor positioned along the transport path between the input receptacle and the output receptacle;

a plurality of bill passage sensors sequentially disposed along the transport mechanism, each of the plurality of bill passage sensors being adapted detect the passage of a bill as each bill is transported past each bill passage sensor, each of the plurality of bill passage sensors being adapted to generate a signal upon the detection of each bill as each bill is transported past each bill passage sensor;

an encoder adapted to produce an encoder count for each incremental movement of the transport mechanism; and a controller being adapted to track the movement of each bill along the transport path, the controller being electrically coupled to the encoder, the transport mechanism, and each of the plurality of bill passage sensors, the controller being adapted to control the operation of the transport mechanism, the controller being adapted to calculate a range of encoder counts in which each of the bills is to be transported past each one of the plurality of bill passage sensors, the controller being adapted to receive the signal from each of the plurality of bill passage sensors, the controller being adapted to recalculate the range of encoder counts in which each of the bills is to be transported past each subsequent bill passage sensor after receiving the signal from each of the plurality of bill passage sensors, the controller being adapted to suspend the operation of the transport mechanism when the controller does not receive the signal from one of the plurality of bill passage sensors within the calculated range of encoder counts.

65. The currency evaluation device of claim 64 wherein the controller is adapted to produce a signal indicative of which of the plurality of bill passage sensors failed to detect the presence of a bill upon the suspension of the operation of the transport mechanism, and wherein the currency evaluation device further comprises a user interface being adapted to receive the signal from the controller, the user interface being adapted to communicate to a user which of the plurality of bill passage sensors failed to detect the presence of a bill.

66. A currency evaluation device for monitoring the transportation of bills being evaluated by the device, the device comprising:

an input receptacle being adapted to receive a stack of bills to be evaluated;

a plurality of output receptacles being adapted to receive the bills after the bills have been evaluated;

a transport mechanism being adapted to transport the bills along a transport path, one at a time, from the input receptacle to the output receptacles;

an evaluation region being adapted to determine information concerning the bills, the evaluation region including at least one bill information sensor positioned along the transport path between the input receptacle and the output receptacle;

a plurality of bill passage sensors sequentially disposed along the transport mechanism, each of the plurality of bill passage sensors being adapted to detect the passage of a bill as each bill is transported past each bill passage sensor, each of the plurality of bill passage sensors being adapted to generate a signal upon the detection of each bill as each bill is transported past each bill passage sensor, the plurality of bill passage sensors including a first and a second bill passage sensor;

an encoder adapted to produce an encoder count for each incremental movement of the transport mechanism; and a controller being adapted to track the movement of each bill along the transport path and to control the operation of the transport path, the controller being electrically coupled to the encoder, the transport mechanism, and each of the plurality of bill passage sensors, the controller being adapted to receive a signal from each of the plurality of bill passage sensors, the controller being adapted to calculate the number of encoder counts required for a bill to be transported past the second bill passage sensor upon receiving a signal from the first bill passage sensor, the controller being adapted to suspend the operation of the transport mechanism when the controller does not receive a signal from the second bill passage sensor within an acceptable deviation from the calculated number of encoder counts required for the bill to be transported past the second bill passage sensor.

67. The currency evaluation device of claim 66 wherein the controller is adapted to produce a signal indicative of the second bill passage sensor not detecting the passage of a bill upon the suspension of the operation of the transport mechanism, and wherein the currency evaluation device further comprises a user interface adapted to receive the signal from the controller, the user interface being adapted to communicate to a user that the second bill passage sensor failed to detect the passage of a bill.

68. The currency evaluation device of claim 66 wherein the plurality of bill passage sensors includes a third bill passage sensor, the controller being adapted to calculate the number of encoder counts required for a bill to be transported past the third bill passage sensor after receiving a signal from the second bill passage sensor, the controller being adapted to suspend operation of the transport mechanism when the controller does not receive a signal from the third bill passage sensor within an acceptable deviation from the calculated number of encoder counts required for the bill to be transported past the third bill passage sensor.

69. The currency evaluation device of claim 68 wherein the controller is adapted to produce a signal indicative of the third bill passage sensor not detecting the passage of a bill upon the suspension of the operation of the transport mechanism, and wherein the currency evaluation device further comprises a user interface adapted to receive the signal from the controller, the user interface being adapted to communicated to a user that the third bill passage sensor failed to detect the passage of a bill.

70. A currency evaluation device for monitoring the transportation of bills being evaluated by the device, the device comprising:

an input receptacle being adapted to receive a stack of bills to be evaluated;

a plurality of output receptacles being adapted to receive the bills after the bills have been evaluated;

a transport mechanism being adapted to transport the bills along a transport path, one at a time, from the input receptacle to the output receptacles;

an evaluation region being adapted to determine information concerning the bills, the evaluation region including at least one bill information sensor positioned along the transport path between the input receptacle and the output receptacle;

a plurality of bill passage sensors sequentially disposed along the transport mechanism, each of the plurality of bill passage sensors being adapted detect the passage of a bill as each bill is transported past each bill passage sensor, each of the plurality of bill passage sensors being adapted to generate a signal upon the detection of each bill as each bill is transported past each bill passage sensor, the plurality of bill passage sensors including a first and a second bill passage sensor; and a controller being adapted to track the movement of each bill along the transport path and to control the operation of the transport path, the controller being electrically coupled to the transport mechanism and each of the plurality of bill passage sensors, the controller being adapted to receive a signal from each of the plurality of bill passage sensors, the controller being adapted to calculate the time required for a bill to be transported past the second bill passage sensor upon receiving a signal from the first bill passage sensor, the controller being adapted to suspend the operation of the transport mechanism when the controller does not receive a signal from the second bill passage sensor within an acceptable deviation from the calculated number of time required for the bill to be transported past the second bill passage sensor.

71. The currency evaluation device of claim 70 wherein the controller is adapted to produce a signal indicative of the second bill passage sensor not detecting the passage of a bill upon the suspension of the operation of the transport mechanism, and wherein the currency evaluation device further comprises a user interface adapted to receive the signal from the controller, the user interface being adapted to communicate to a user that the second bill passage sensor failed to detect the passage of a bill.

72. The currency evaluation device of claim 70 wherein the plurality of bill passage sensors includes a third bill passage sensor, the controller being adapted to calculate the time required for a bill to be transported past the third bill passage sensor after receiving a signal from the second bill passage sensor, the controller being adapted to suspend operation of the transport mechanism when the controller does not receive a signal from the third bill passage sensor within an acceptable deviation from the calculated time required for the bill to be transported past the third bill passage sensor.

73. The currency evaluation device of claim 72 wherein the controller is adapted to produce a signal indicative of the third bill passage sensor not detecting the passage of a bill upon the suspension of the operation of the transport mechanism, and wherein the currency evaluation device further comprises a user interface adapted to receive the signal from the controller, the user interface being adapted to communicate to a user that the third bill passage sensor failed to detect the passage of a bill.

74. An apparatus for feeding a plurality of stacked currency bills into a currency handling device, the apparatus comprising:

a receptacle being adapted to receive a plurality of stacked bills, the receptacle having a first and a second side, a front end, and a floor;

a feeder mechanism disposed in the front end of the receptacle, the feeder mechanism being adapted to transfer the bills, one at a time, from the receptacle to the currency handling device;

a first rigid member disposed along the first side;

a second rigid member disposed along the second side;

a first paddle pivotally and slidably engaged to the first rigid member, the first paddle having a substantially flat surface being adapted to contact a plurality of stacked bills;

a second paddle pivotally and slidably engaged to the second rigid member, the second paddle having a substantially flat surface being adapted to contact a plurality of stacked bills;

a first resilient member coupled to the first paddle, the first resilient member being adapted to bias the first paddle towards the front end of the receptacle; and a second resilient member coupled to the second paddle, the second resilient member being adapted to bias the second paddle towards the front end of the receptacle.

75. The apparatus of claim 74 further comprising:

at least one track disposed in the floor of the receptacle, the track having a width;

at least one channel disposed in the bottom surface of the first paddle, the width of the channel being slightly larger than the width of the track, the channel being adapted to fit around the track, the channel being adapted to slide along the track; and at least one channel disposed in the bottom surface of the second paddle, the width of the channel being slightly larger than the width of the track, the channel being adapted to fit around the track, the channel being adapted to slide along the track.

76. The apparatus of claim 74 further comprising a handle attached to the first paddle.

77. The apparatus of claim 74 further comprising a handle attached to the second paddle.

78. The apparatus of claim 74 wherein the first paddle has a bottom surface, the apparatus further comprising a roller attached to the first paddle, the roller extending slightly beyond the bottom surface of the of the first paddle, the roller being adapted to roll along the floor of the receptacle as the first paddle urges the plurality of stacked bills towards the feeder mechanism.

79. The apparatus of claim 74 wherein the second paddle has a bottom surface, the apparatus further comprising a roller attached to the second paddle, the roller extending slightly beyond the bottom surface of the of the second paddle, the roller being adapted to roll along the floor of the receptacle as the second paddle urges the plurality of stacked bills towards the feeder mechanism.

80. The apparatus of claim 74 wherein the receptacle and the feeder mechanism are adapted to accommodate bills ranging in size from about 4.39 inches long by about 2.40 inches wide to about 7.17 inches long by about 3.82 inches wide.

81. The apparatus of claim 74 wherein the feeder mechanism comprises at least one stripping wheel.

82. The apparatus of claim 81 wherein the at least one stripping wheel comprises two stripping wheels.

83. A method for loading a plurality of stacks of currency bills into a currency handling device, the currency handling device having an input receptacle being adapted to receive a plurality of stacks of bills, the input receptacle having a front end and a back end, the input receptacle having a feeder mechanism disposed in the front end of the input receptacle, the feeder mechanism being adapted to transfer the bills, one at a time, from the receptacle into the currency handling device, the input receptacle having a first paddle and a second paddle each being adapted to urge the stacked bills towards the feeder mechanism, the method comprising:

retracting the first and the second paddle toward the back of the receptacle;

placing a first stack of bills in the input receptacle between the first paddle and the feeder mechanism;

releasing the first and the second paddle so that the first paddle presses up against the first stack of bills and the second paddle presses against the first paddle;

the first paddle urging the first stack of bills towards the front end of the receptacle;

retracting the second paddle towards the back end of the receptacle;

placing a second stack of bills in the input receptacle between the first paddle and the second paddle;

positioning the second paddle against the second stack of bills to that the second stack of bills presses against the first paddle;

the second paddle urging the second stack of bills towards the front end of the receptacle and into the first paddle;

upwardly pivoting the first paddle out of the input receptacle so that the first and the second stacks of bills form a combined stack;

the second paddle urging the combined stack of bills towards the front end of the receptacle;

retracting the first paddle towards the back end of the receptacle;

downwardly pivoting the first paddle into the input receptacle; and positioning the first paddle behind the second paddle.

84. The method of claim 83 wherein the feeder mechanism comprises at least one stripping wheel.

85. The method of claim 83 wherein the receptacle has a floor, and the first and the second paddle each have at least one channel disposed therein being adapted to slide along a corresponding track disposed in the floor of the receptacle.

86. The method of claim 83 wherein the first and the second paddle each have a handle attached thereto.

87. The method of claim 83 wherein the input receptacle has a floor, and wherein the first and the second paddle each have a roller attached thereto, the roller being adapted to roll along a floor of the receptacle.

88. The method of claim 83 wherein the receptacle and the feeder mechanism are adapted to accommodate bills ranging in size from about 4.39 inches long by about 2.40 inches wide to about 7.17 inches long by about 3.82 inches.

89. The method of claim 83 wherein the input receptacle further includes a first spring coupled to the first paddle and a second spring coupled to the second paddle, the first and second springs each being adapted to urge the first and second paddles, respectively, towards the feeder mechanism.

* * * * *